US008157436B2

(12) United States Patent
Curtis et al.

(10) Patent No.: US 8,157,436 B2
(45) Date of Patent: Apr. 17, 2012

(54) MULTI-SIZE MIXER

(75) Inventors: Aaron Curtis, Eagan, MN (US); Stephen J. Carlson, Shorewood, MN (US); Charles Ringhofer, Wayzata, MN (US); Benjamin M. Johnson, Zimmerman, MN (US); Brent Thomas Harrold, Savage, MN (US); Thomas J. Midas, Oak Park Heights, MN (US)

(73) Assignee: Red Devil Equipment Company, Plymouth, MN (US)

( * ) Notice: Subject to any disclaimer, the term of this patent is extended or adjusted under 35 U.S.C. 154(b) by 601 days.

(21) Appl. No.: 12/370,260

(22) Filed: Feb. 12, 2009

(65) Prior Publication Data

US 2009/0207690 A1 Aug. 20, 2009

Related U.S. Application Data

(60) Provisional application No. 61/029,149, filed on Feb. 15, 2008.

(51) Int. Cl.
*B01F 11/00* (2006.01)
*B01F 9/00* (2006.01)

(52) U.S. Cl. ..... 366/217; 366/208; 366/209; 366/605; 366/197

(58) Field of Classification Search ..... 366/197, 366/208–219, 605
See application file for complete search history.

(56) References Cited

U.S. PATENT DOCUMENTS

| | | | | | |
|---|---|---|---|---|---|
| 830,010 | A | * | 9/1906 | Sanders | 366/212 |
| 1,012,446 | A | * | 12/1911 | Sanders | 366/219 |
| 1,624,701 | A | * | 4/1927 | Weisenborn | 366/212 |
| 2,082,593 | A | * | 6/1937 | Pankotan | 366/212 |
| 4,123,176 | A | | 10/1978 | Barker | |
| 4,281,936 | A | | 8/1981 | Schotter et al. | |
| 4,415,270 | A | | 11/1983 | Heinis et al. | |
| 4,445,782 | A | * | 5/1984 | Sparrow, Jr. | 366/217 |
| 4,568,194 | A | | 2/1986 | Gargioni | |
| 4,789,245 | A | | 12/1988 | Morbeck | |
| 5,197,802 | A | | 3/1993 | Miller | |
| 5,261,744 | A | | 11/1993 | Brunn | |

(Continued)

FOREIGN PATENT DOCUMENTS

DE 9407810 U1 7/1994

(Continued)

OTHER PUBLICATIONS

Invitation to Pay Additional Fees and, Where Applicable, Protest Fee and Partial Search Report issued in PCT/US2009/033904, mailed Jun. 3, 2009, 8 pages.

*Primary Examiner* — Joseph Del Sole
*Assistant Examiner* — Nahida Sultana
(74) *Attorney, Agent, or Firm* — Faegre Baker Daniels LLP

(57) ABSTRACT

A gyroscopic paint mixer having a rotatable frame with a clamp lock providing automatic transfer from an unclamping to a clamping condition, providing silent operation through the use of one way clutches, the mixer also having a vertical stop apparatus coupled to an access door for stopping and holding the rotatable frame in an upright position, the mixer also having a bail retainer supported by a carriage assembly mounted for rotation on a clamp plate with a cam urging the bail retainer to the side of the frame when the bail retainer is released from the paint container with the paint container in an upright position in the rotatable frame.

10 Claims, 25 Drawing Sheets

U.S. PATENT DOCUMENTS

| | | | | |
|---|---|---|---|---|
| 5,437,505 | A * | 8/1995 | Sanders et al. | 366/209 |
| 5,462,353 | A * | 10/1995 | Gatlin | 366/209 |
| 5,466,065 | A * | 11/1995 | Catrombon | 366/209 |
| 5,711,601 | A | 1/1998 | Thomas et al. | |
| 5,788,371 | A | 8/1998 | Neri et al. | |
| 5,897,204 | A | 4/1999 | Dittmer et al. | |
| 7,059,763 | B2 | 6/2006 | Sordelli et al. | |
| 7,165,879 | B2 | 1/2007 | Midas et al. | |
| 7,284,901 | B2 | 10/2007 | Midas et al. | |
| 7,311,437 | B2 * | 12/2007 | Midas et al. | 366/217 |
| 2002/0044495 | A1 * | 4/2002 | Friedman | 366/212 |
| 2003/0012082 | A1 * | 1/2003 | Carter | 366/213 |
| 2004/0202045 | A1 | 10/2004 | Marazzi et al. | |
| 2006/0062077 | A1 * | 3/2006 | Santospago et al. | 366/209 |
| 2007/0081418 | A1 * | 4/2007 | Midas et al. | 366/209 |

FOREIGN PATENT DOCUMENTS

| | | | |
|---|---|---|---|
| DE | 4416593 | C1 | 9/1995 |
| EP | 1123732 | A | 8/2001 |
| WO | WO 2008/095968 | A | 8/2008 |

* cited by examiner

MULTI-SIZE MIXER

CROSS REFERENCE TO RELATED APPLICATION

This application claims the benefit of U.S. Provisional Application No. 61/029,149, filed Feb. 15, 2008, the entire contents of which are hereby expressly incorporated by reference.

TECHNICAL FIELD

The present invention relates to the field of paint mixers, more particularly including, but not limited to gyroscopic mixers used to custom blend pigment in paint containers. As used herein, "paint" means conventional paint and similar coating materials.

BACKGROUND

In the past, various types of mixers, including gyroscopic paint mixers, have been used to mix paint in retail establishments. While such mixers have been widely accepted, there remain opportunities to improve such mixers. One such opportunity is to provide an improved vertical mechanism to stop the clamp in an upright position. Another opportunity is to provide an improved bail retention mechanism. Another opportunity is to provide an improve clamping operation to hold the paint container in the mixer.

SUMMARY

The present invention is an improvement for a paint mixer (including gyroscopic types) having a clamp capable of holding a range of different sizes of paint containers for mixing by spinning the paint container about a spin axis coincident with a cylindrical axis of the container, and simultaneously rotating the axis about a tumble axis. The present invention provides a "vertical lock" mechanism to hold the clamp in an upright condition to assist a user in loading and unloading the paint container from the clamp of the mixer. When this aspect of the present invention is used with a gyroscopic mixer having a rotating frame, the frame may, in certain circumstances, be automatically stopped and held in an upright condition. In particular, when an access door of the mixer is opened when the frame is coasting after a mixing cycle, the frame may be stopped and held upright by the present invention. Alternatively, when the frame is stopped before the access door is opened, the frame may be manually rotated by a user to the upright condition at which time the present invention will positively hold the frame upright.

When the access door is closed, the vertical lock of the present invention will automatically release the frame for mixing rotation.

In another aspect, the present invention includes a bail retention mechanism that automatically moves out of the way when released from retaining the bail of the paint container.

In another aspect, when the bail retainer in a form of a helical spring, an inner core inside the spring in its collapsed condition is provided to support the spring against inelastic deformation that may otherwise occur in the event the spring is struck by a paint container while loading or unloading the mixer.

In another aspect, the present invention includes a trigger-released clamp lock mechanism that automatically moves to a CLAMPING condition when a pair of clamping plates are moved toward each other, and, alternatively, retains an UNCLAMPING condition when triggered in preparation for moving the clamping plates away from each other. When used with the one way clutches described infra, in this aspect, the present invention also provides an improvement over prior art ratcheting locks for gyro mixer clamps by providing a silent operation in contrast to the audible clicking sound made by certain prior art ratcheting clamps.

DETAILED DESCRIPTION

Figure 1:
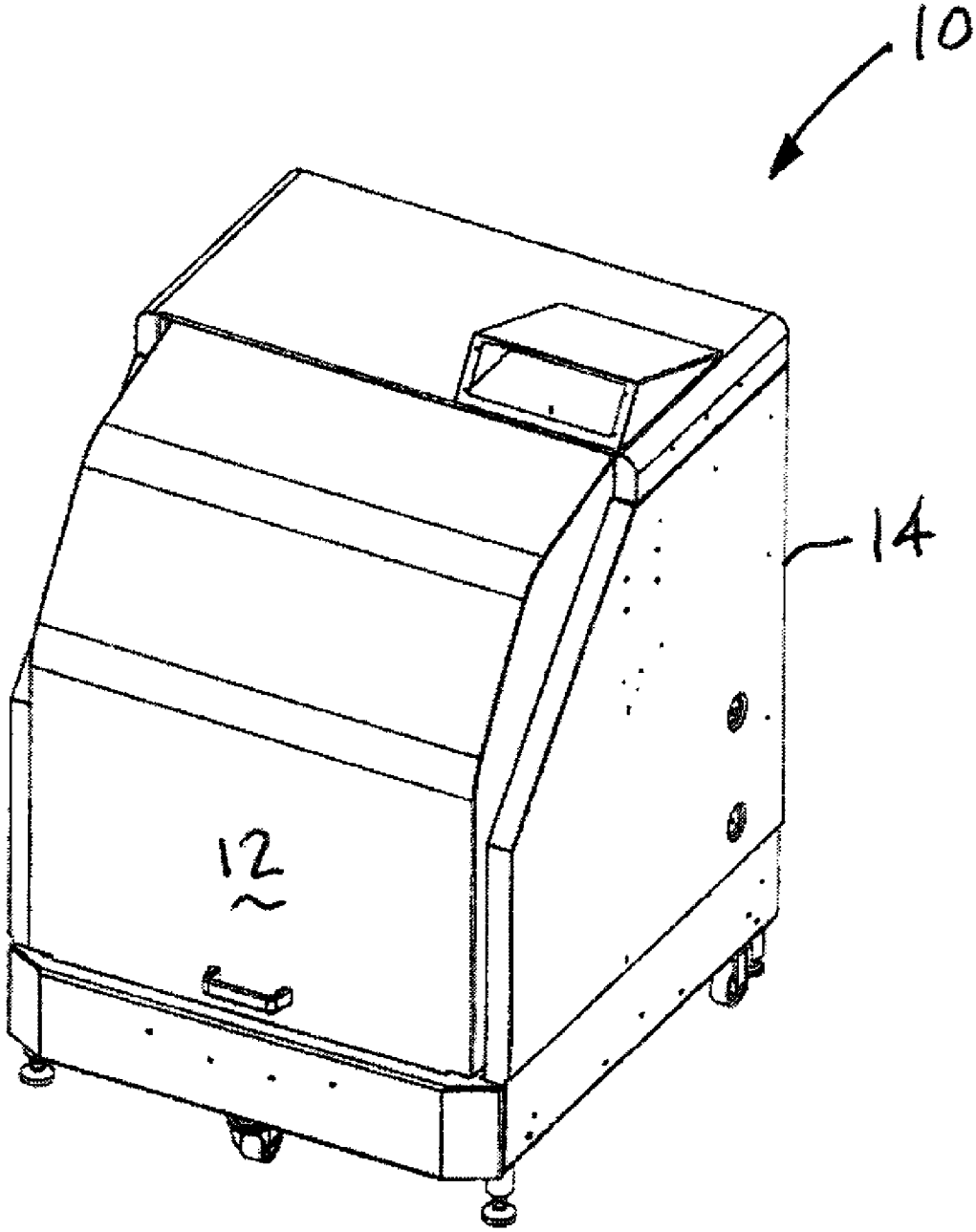
FIG. 1 is a perspective view of a mixer embodiment of the present invention with an access door closed.
Figure 2:
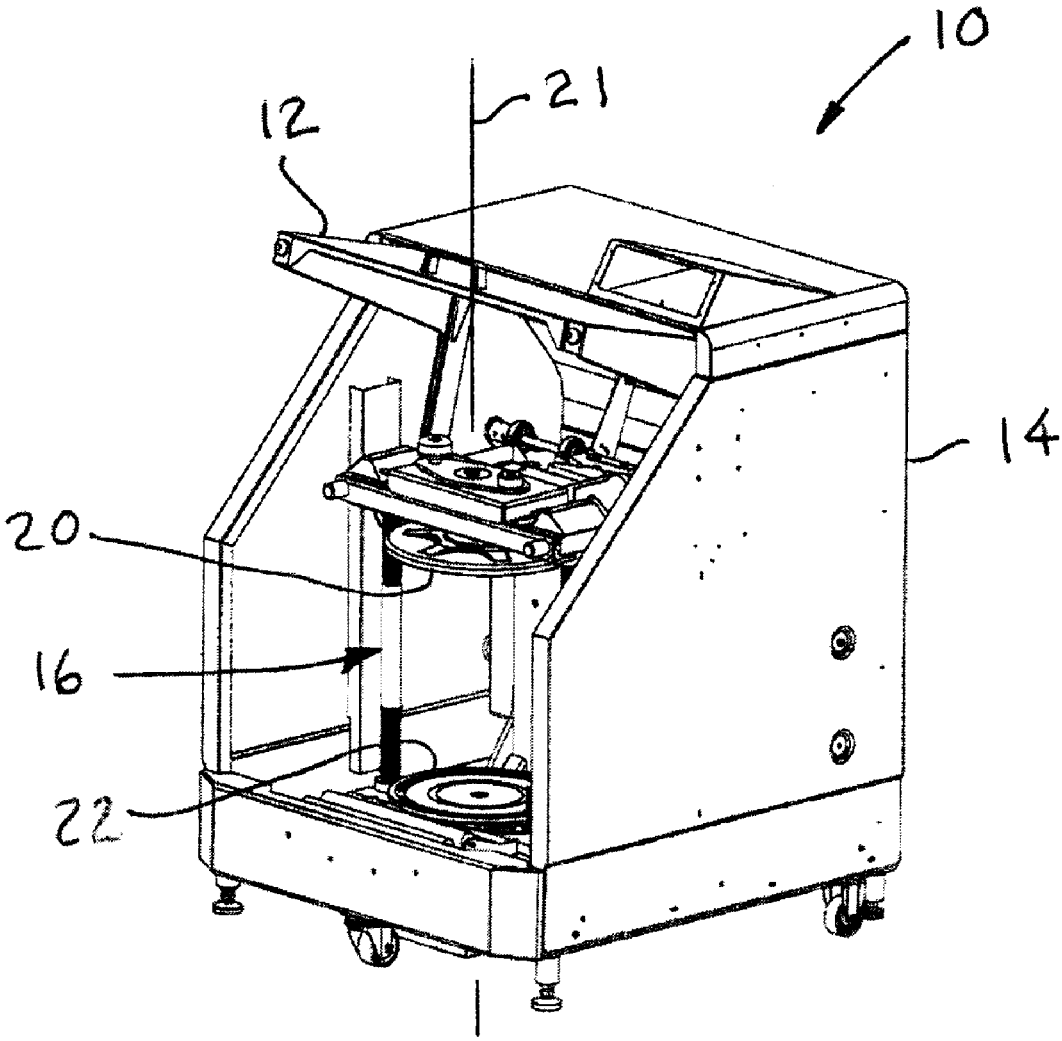
FIG. 2 is a perspective view similar to that of FIG. 1, except with the access door open.
Figure 3:
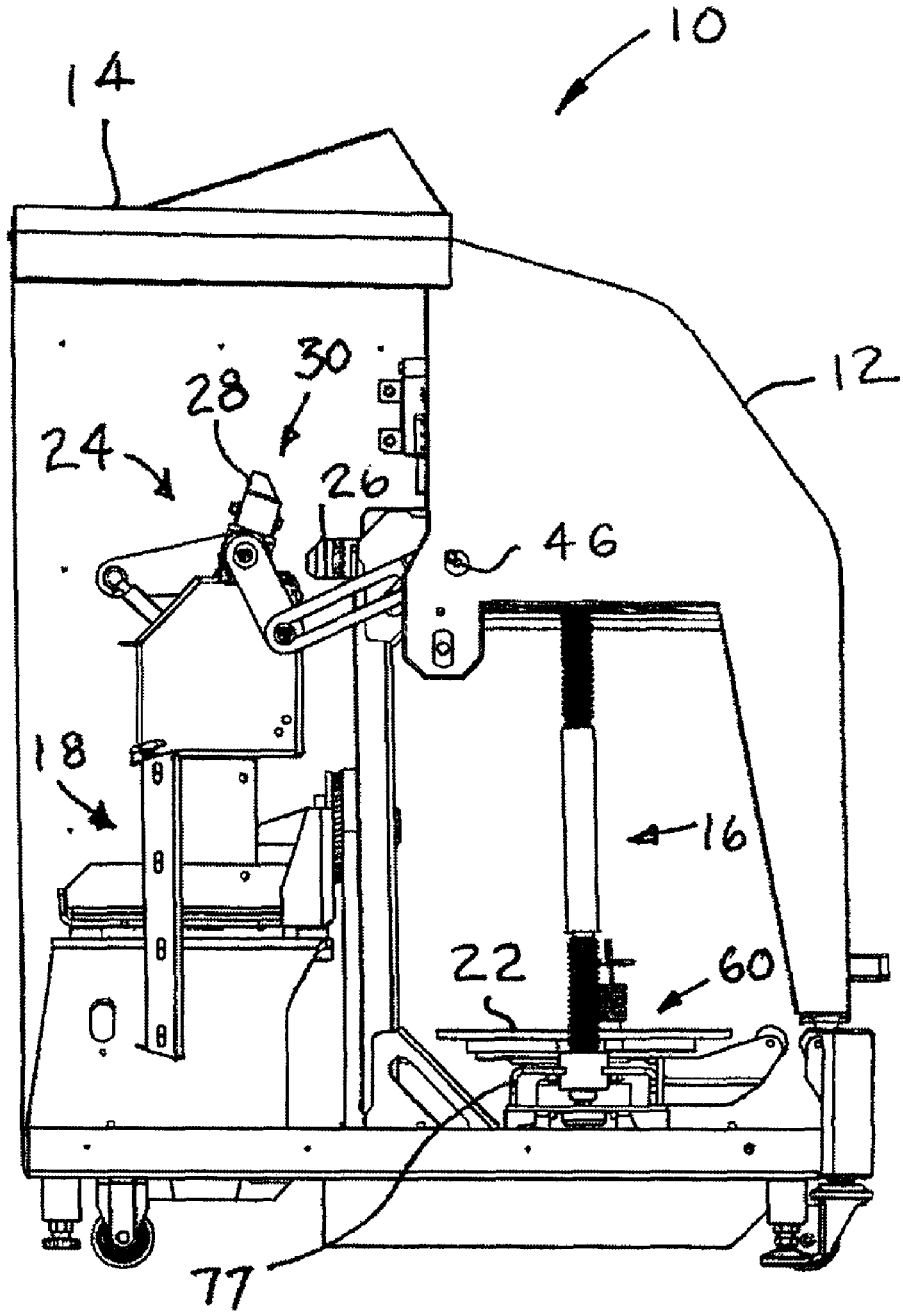
FIG. 3 is a right side elevation view of the mixer of FIG. 1, except with the right hand side panel of the enclosure removed to show internal parts of the mixer including the access door in the closed position.
Figure 4:
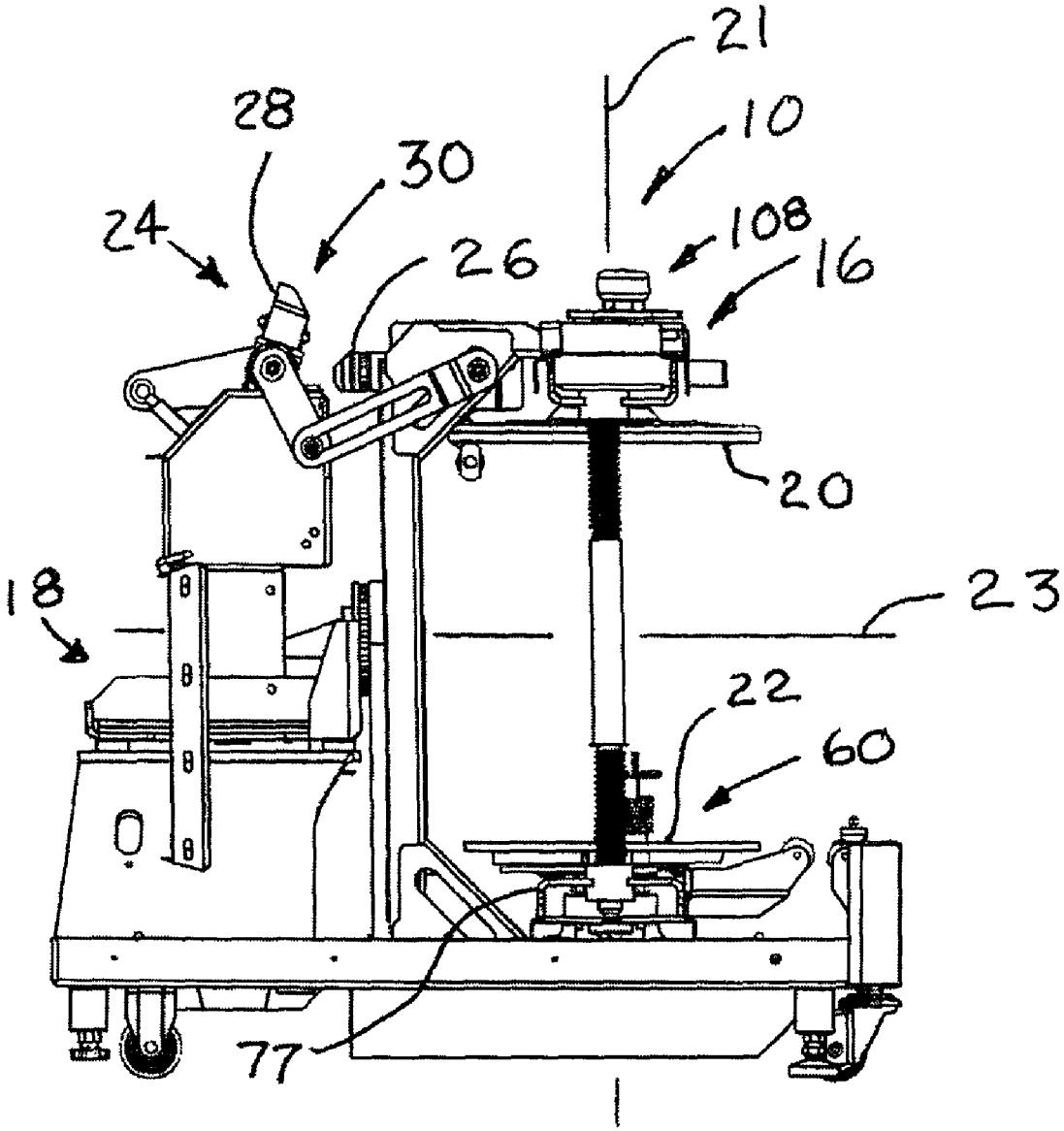
FIG. 4 is a view similar to that of FIG. 3, except with door and additional parts of the enclosure removed to more clearly show the internal parts of the mixer.

Referring to the Figures, and most particularly to FIGS. 1-4, a paint mixer 10 useful in the practice of the present invention may be seen. Mixer 10 has an access door 12, shown closed in FIGS. 1 and 3 and open in FIG. 2. Door 12 is part of an enclosure 14 for the mixer 10. With reference to FIGS. 2, 3 and 4, it may be seen that mixer 10 is a gyroscopic mixer having a rotatable frame 16 mounted for rotation on a non-rotating assembly 18. However, it is to be understood that certain aspects of the present invention may be applicable to non-gyroscopic mixers, as well.

The non-rotating assembly 18 includes a support and a drive for the frame 16. It is to be understood that frame 16 has a pair of opposed clamp plates 20, 22 and provides both a spinning and tumbling motion for mixing paint in a container clamped between plates 20 and 22. In the embodiment shown, it has been found preferable to have a 2:1 spin-to-tumble ratio, but other ratios are also possible while still remaining within the scope of the present invention. With a 2:1 ratio, the paint container will come to rest in the same orientation with respect to the spin axis after mixing as it was when loaded into the frame prior to mixing. Other integer ratios are also able to be used in the practice of the present invention as it relates to the bail retainer retraction, so that the lower or driven clamp plate will always come to rest to position the bail retainer to one side as driven by the retraction mechanism 60, as described in more detail, infra. Referring particularly to FIGS. 2 and 4-7, it is understood that a spin axis 21 passes through the center of the clamp plates, and a tumble axis 23 passes perpendicularly through the spin axis 21. The frame 16 is capable of clamping various sizes of paint containers by moving both plates 20 and 22 towards each other to maintain balance during tumble rotation. However, certain aspects of the present invention may be practiced with a mixer having a frame in which only one plate moves during clamping.

FIG. 3 shows a view of mixer 10 with a side panel of the enclosure 14 removed. A frame positioning apparatus 24 includes a first stop block 26 mounted on the rotatable frame 16 and a second stop block 28 mounted on the non-rotating assembly 18. Second stop block 28 is shown in FIG. 3 in a first position 30 which is out of the rotational path of and thus provides clearance for the first stop block 26. The position 30 corresponds to a closed condition of the access door 12, as shown in FIG. 3. With the second stop block 28 out of the path of the first stop block 26, the frame 16 is free to rotate to mix paint (with the door 12 closed). FIG. 4 shows the mixer 10 with the door 12 and enclosure 14 omitted, and with parts of the apparatus 24 shown in the "door closed" condition with stop block 28 in position 30.

Figure 5:
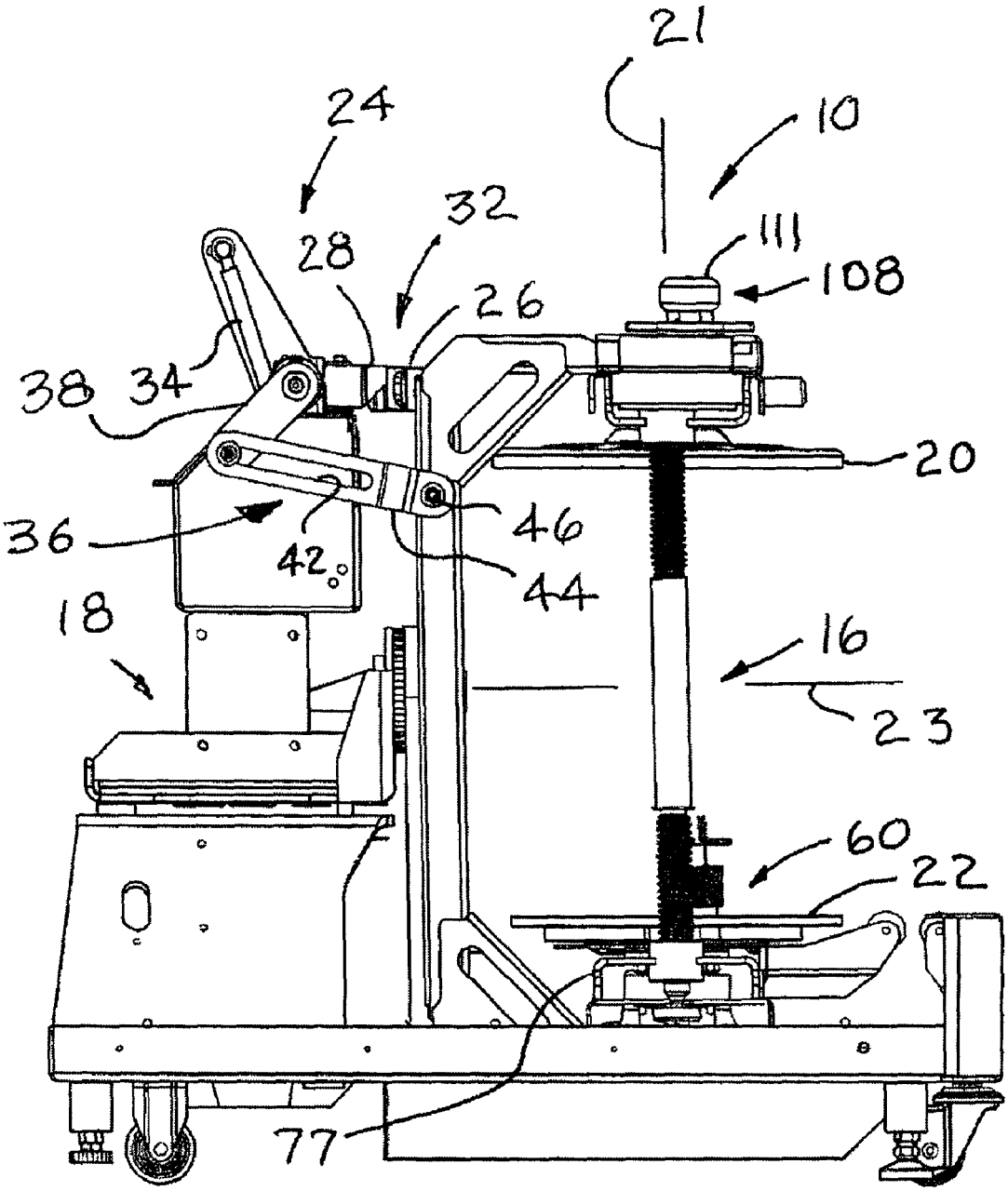
FIG. 5 is a view similar to that of FIG. 4, except with internal parts of the mixer shown in an upright and locked condition.
Figure 6:
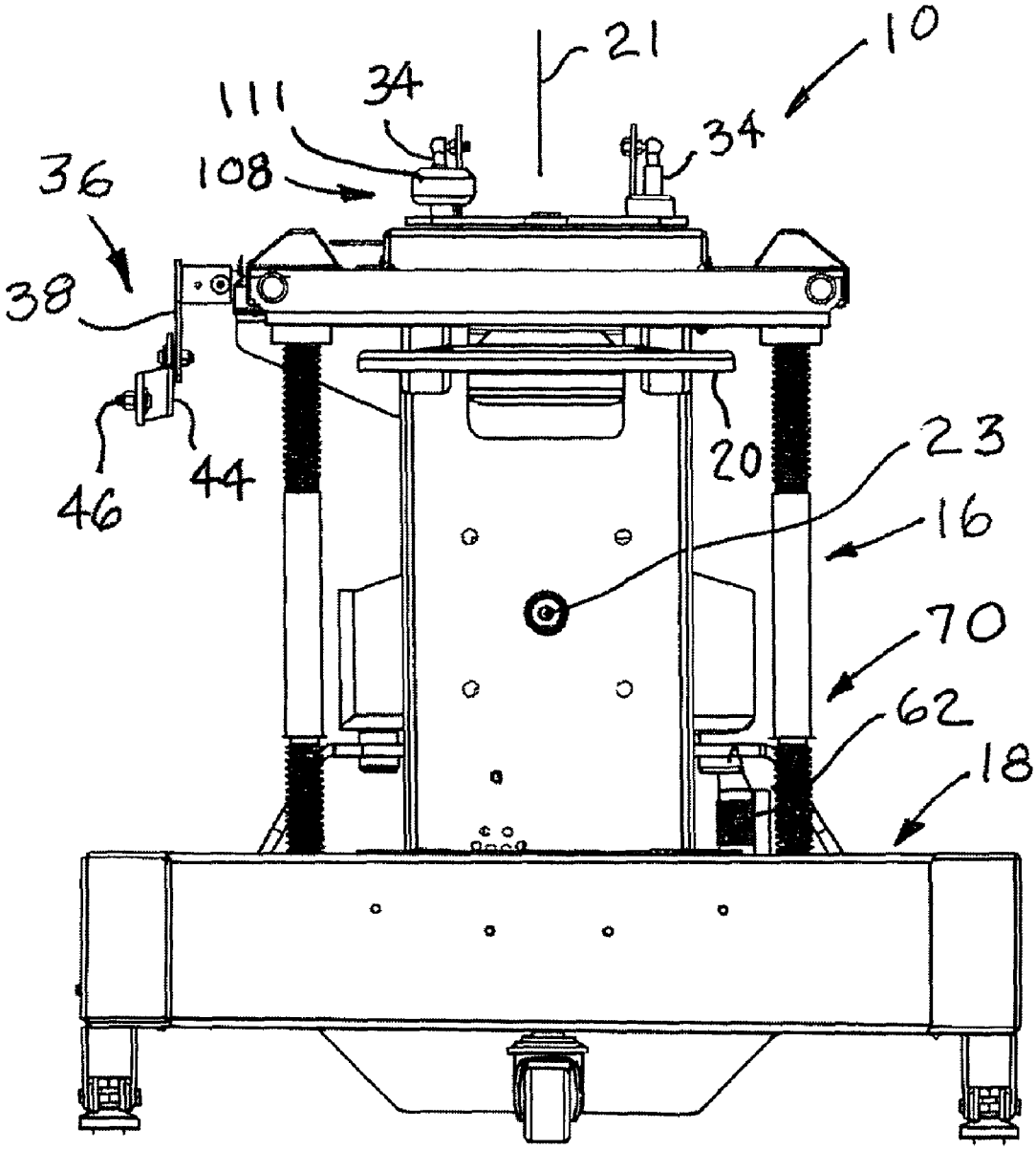
FIG. 6 is a front elevation view of the parts shown in FIG. 5.
Figure 7:
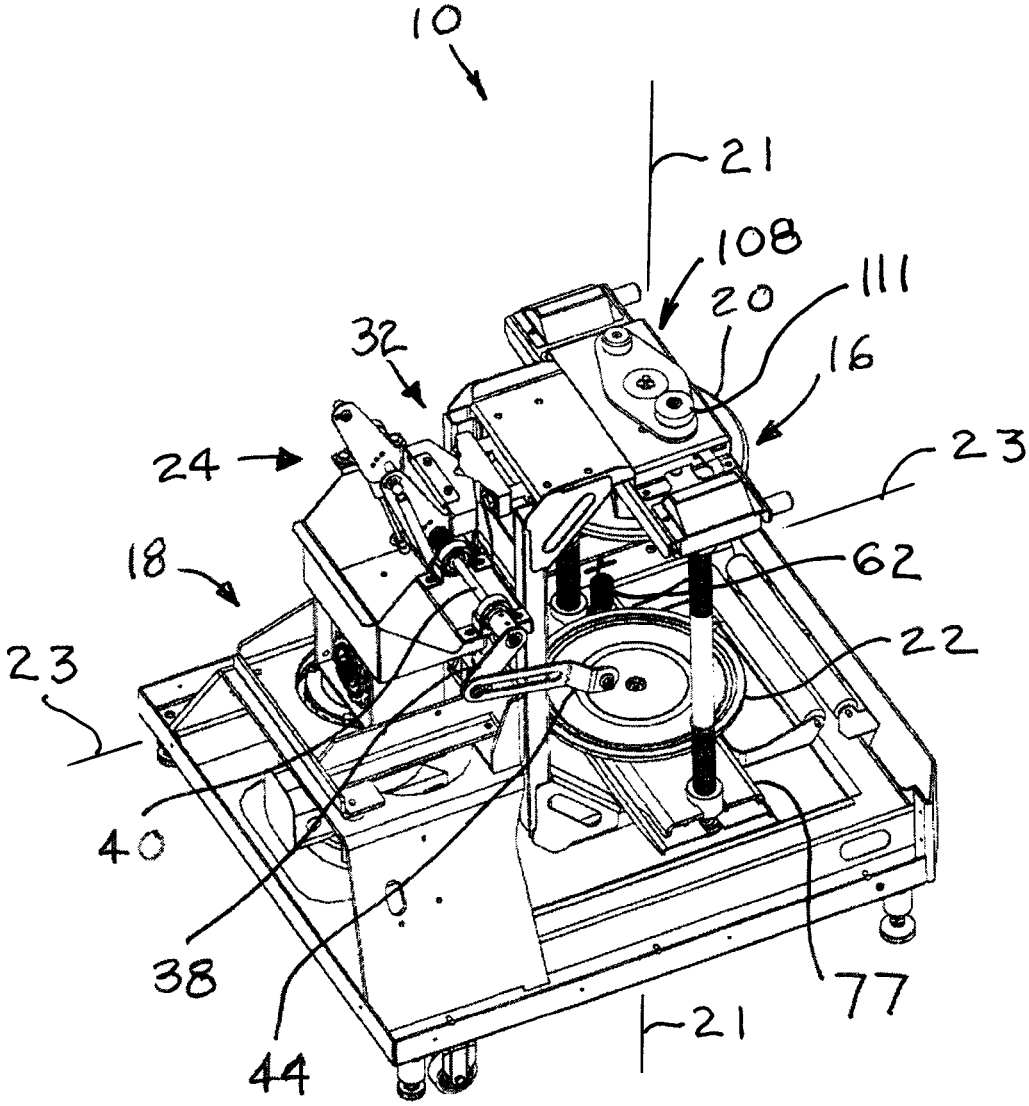
FIG. 7 is a perspective view from above and to the rear of the right side of the parts shown in FIG. 5.
Figure 8:
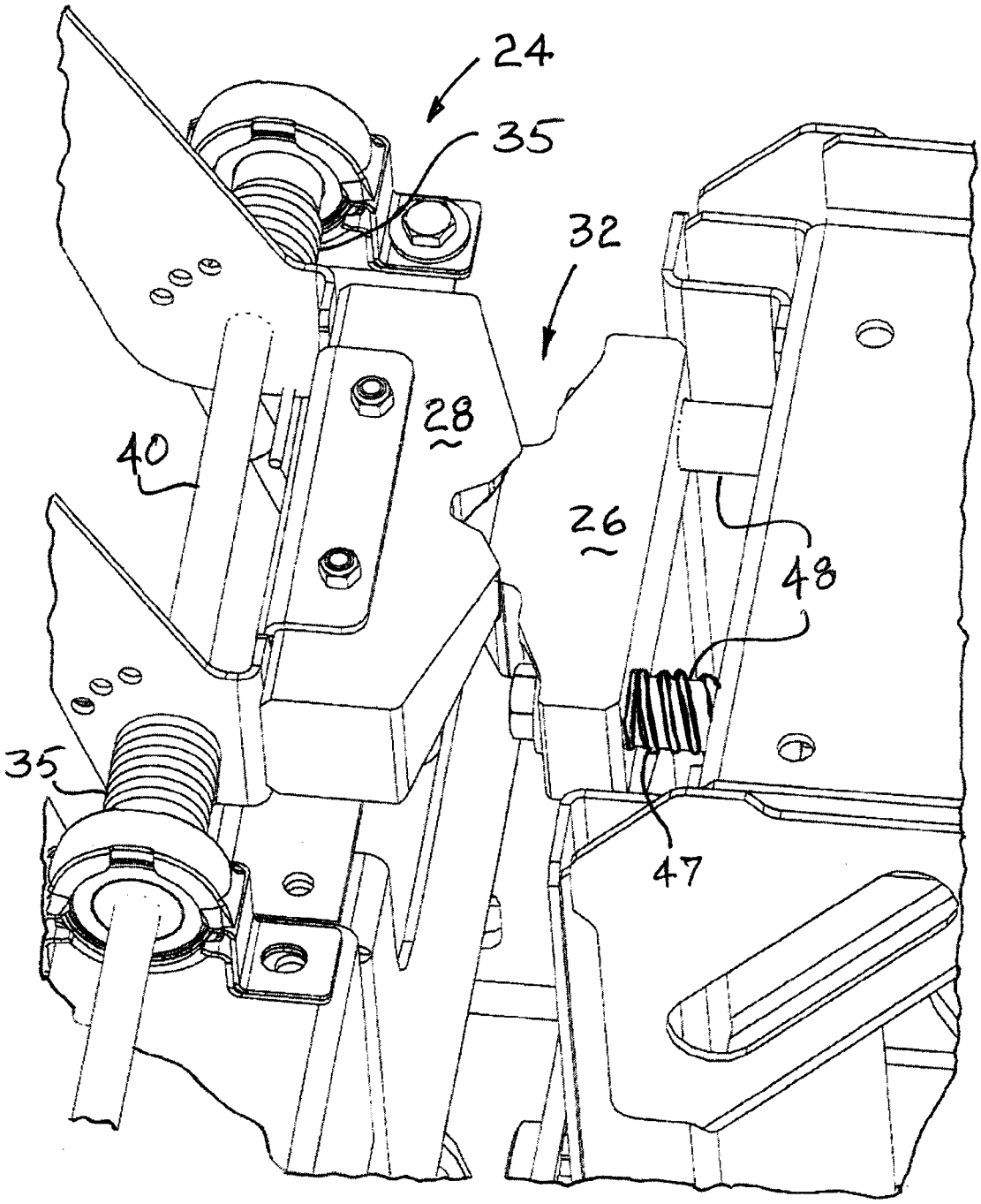
FIG. 8 is an enlarged fragmentary perspective view of parts from FIG. 7 to illustrate certain features of the present invention including details of a vertical lock subassembly for the rotatable mixing apparatus of the mixer, showing the vertical lock subassembly in a LOCKED position.
Figure 9:
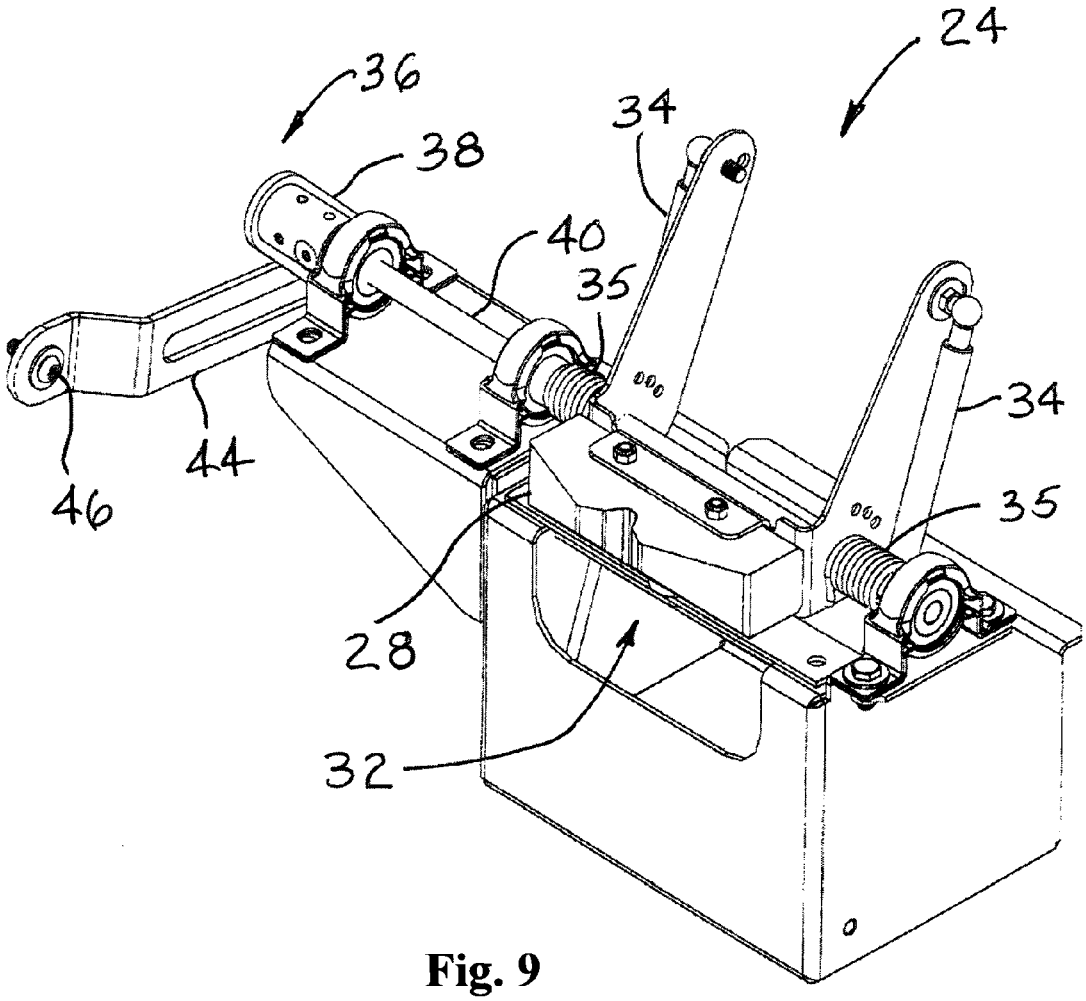
FIG. 9 is a perspective view of the vertical lock subassembly from FIG. 7 shown in the LOCKED position.
Figure 10:
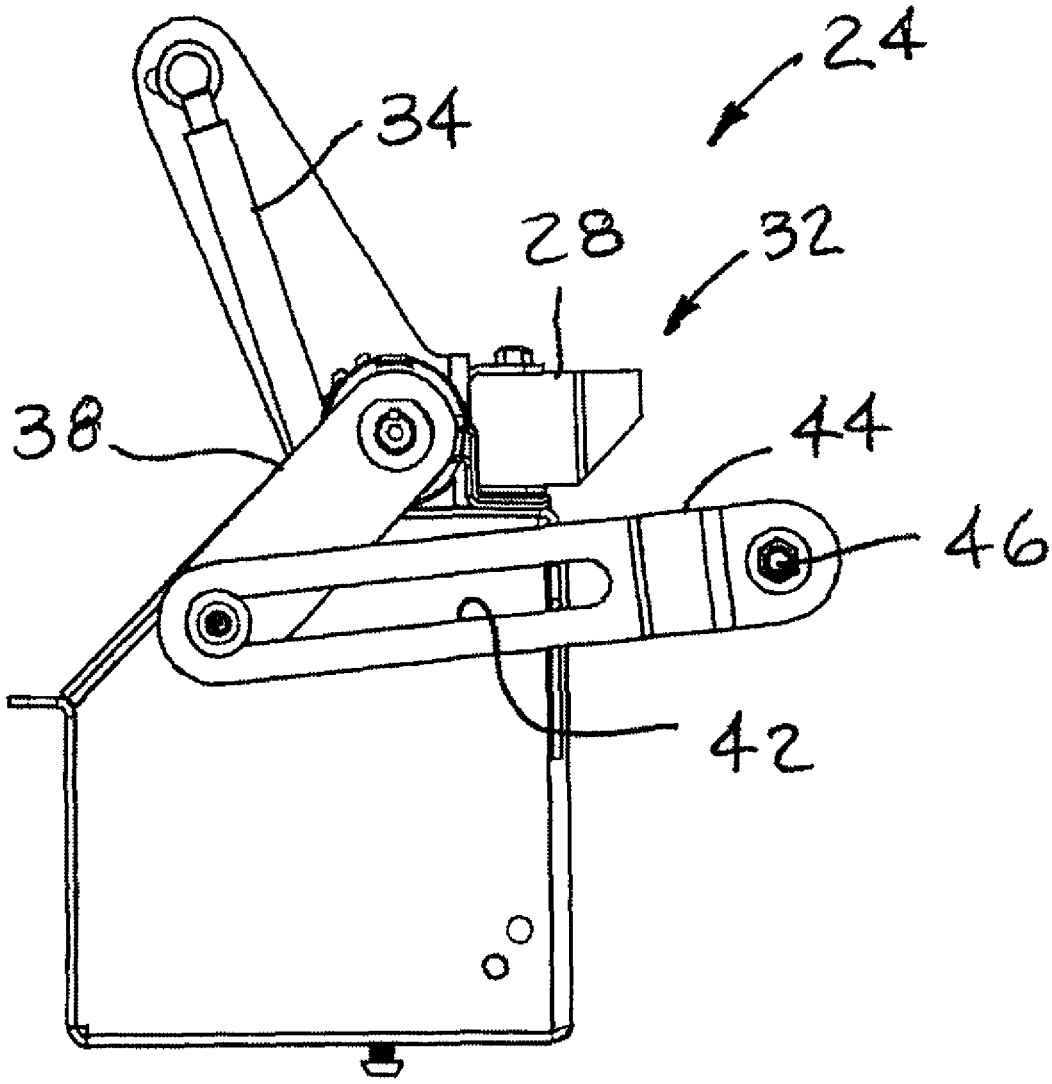
FIG. 10 is a right side elevation view of the subassembly of FIG. 9.

FIGS. 2 and 5-7 show the mixer 10 and frame positioning apparatus 24 in a steady state or quiescent "door open" condition. It is to be understood that in normal operation door 12 is opened only after a mixing cycle is completed. If the door 12 is opened immediately after (or during) a mixing cycle, the frame 16 will attempt to continue rotating to coast to a stop. The apparatus 24 includes a predetermined delay (on the order of several seconds) before moving the second stop block 28 to a second position 32 in which the second stop block is in alignment with the path of the first stop block 26. As the frame rotates itself in the final stages of coasting (or, alternatively, when it is moved manually after coming to rest in a non-upright condition) the frame 16 will carry the first stop block 26 into engagement with the second stop block 28, as shown in FIGS. 5, 7 and 8. A delay in the range of 3 to 6 seconds before first contact, corresponding to a range of between 4 to 10 seconds to full contact, has been found desirable to avoid a sudden, jarring stop for the frame and paint container. Once the stop blocks 26 and 28 are in engagement with each other, the rotatable frame 16 is held in an upright position by the frame positioning apparatus 24 to assist a user in unloading or loading a paint container into the frame 16.

The frame positioning apparatus 24 includes means for providing the predetermined delay. In one embodiment, the means for providing the predetermined delay may include at least one and preferably two hydraulic dampers 34 which slow movement of the second stop block 28 when moving from the first position 30 to the second position 32. It is preferable that the damper or dampers 34 (or other equivalent means for providing the predetermined delay) do not retard movement of the second stop block 28 when moving from the second position 32 to the first position 30, to enable clearance for frame rotation as soon as possible. It is also to be understood that other equivalents may be used as the means for providing the predetermined delay, such as pneumatic dampers or an electric or electronically controlled actuator to control movement of the second stop block from the first position 30 to the second position 32.

In the embodiment shown, at least one, and preferably two helical torsion springs 35 (see FIG. 8) are used to urge the second stop block 28 towards the second position 32. Alternatively other force-generating devices, for example gas springs) may be used for springs 35 while still remaining within the present invention to provide a force to urge the second stop block 28 towards the second position 32. The frame positioning apparatus 24 includes a lost motion mechanism 36 connected to door 12. A crank arm 38 is connected at one end to a shaft 40 to move the second stop block 28 between positions 30 and 32. Crank arm 38 is connected at the other end to a slot 42 in a link 44. Link 44 is connected via a pivot 46 to the door 12. The lost motion mechanism 36 allows the frame positioning apparatus 24 to delay moving the second stop block 28 to the second position 32 in the event the door 12 is opened rapidly. When that occurs, link 44 slides along slot 42 at the junction of crank arm 38 and slot 42, because dampers 34 delay (slow down) motion of the second stop block 28 as urged by springs 35.

Referring now most particularly to FIG. 8, the first stop block 26 is resiliently mounted to the rotatable frame 16 via a pair of springs (only one of which is shown at 47) carried on shafts 48 so that the first stop block 26 is urged toward the second stop block, but is free to move in a direction aligned with the axes of shafts 48. The first stop block 26 is thus able to move in a direction generally perpendicular to a plane of rotation of the frame 16.

Figure 25:
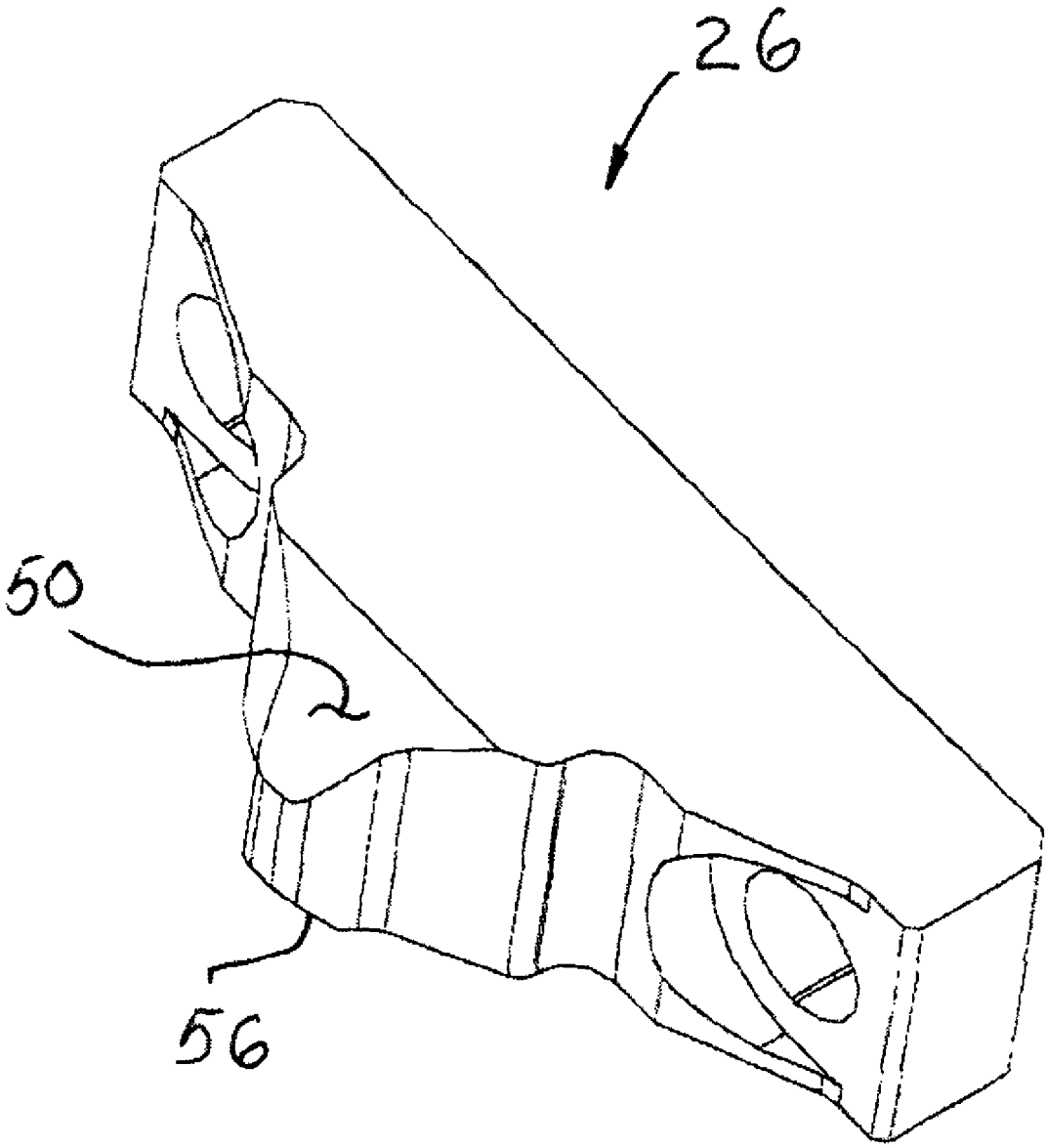
FIG. 25 is a perspective view from the front and above of a first stop block useful in the practice of the present invention.
Figure 26:
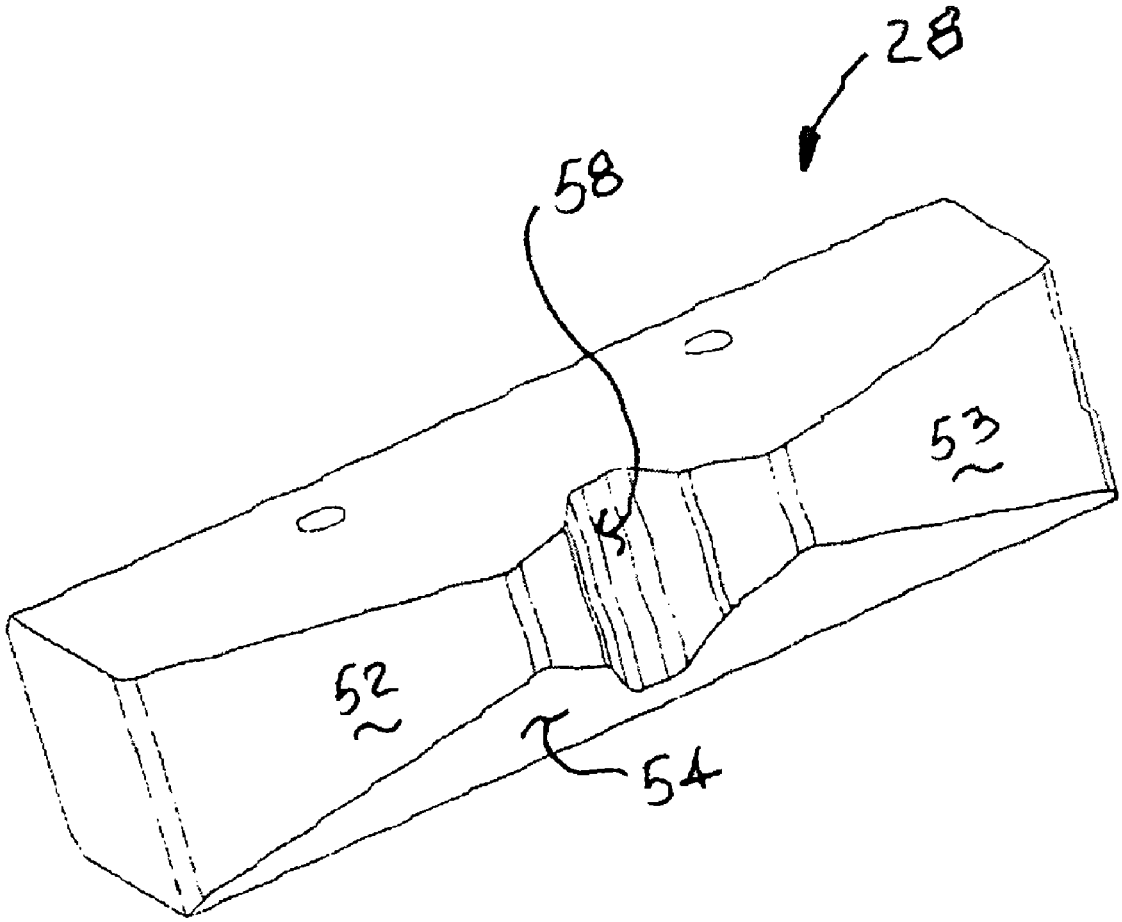
FIG. 26 is a first perspective view from the front and above of a second stop block useful in the practice of the present invention.

Referring now also to FIGS. 25 and 26, in the embodiment shown, the first stop block 26 has at least one tapered surface 50 and the second stop block 28 has three tapered surfaces 52, 53, and 54, which, along with the resilient mounting of the first stop block, allow the stop blocks to move into engagement with each other when the second stop block 28 is moving or has moved into the path of the first stop block 26 towards or in position 32. In the embodiment shown, the first stop block 26 has a protrusion 56 facing the second stop block 28 when the second stop block is in position 32. The second stop block 28 has a recess 58 conforming to and aligned with the protrusion 56 when the stop blocks are engaged with each other. It is to be understood that tapered surfaces 52 and 53 are complementary to each other in that only one will be effective, depending upon the direction of rotation of the frame 16. For example, protrusion 56 on stop block 26 will contact tapered surface 52 on stop block 28 when the second stop block 28 has moved to position 32 before contact with the first stop block 26 and the frame is coasting after a mixing cycle is completed or interrupted. In the event that a mixing cycle has been completed and enough time has elapsed for the frame to coast to a stop before the door 12 is opened, a user may move frame 16 in an opposite direction of rotation, causing contact between protrusion 56 and tapered surface 53 as the stop blocks come into contact and engagement. It is to be understood that (alternatively) the frame 16 may be urged manually in the same direction of rotation as occurs during mixing to engage the stop blocks.

Tapered surface 54 on the second stop block 28 may contact tapered surface 50 on the first stop block 26 if contact between the stop blocks occurs before the second stop block 28 reaches the second ("door open") position 32. After contact between surfaces 54 and 50, the stop blocks will come into engagement as shown most clearly in FIG. 8. It may thus be seen that each of the stop blocks have respective tapered surfaces facing each other. The stop blocks 26 and 28 are preferably formed of nylon or other suitable material. It is to be understood that the protrusion and recess may be located on the opposite stop blocks while still remaining within the present invention.

Figure 11:
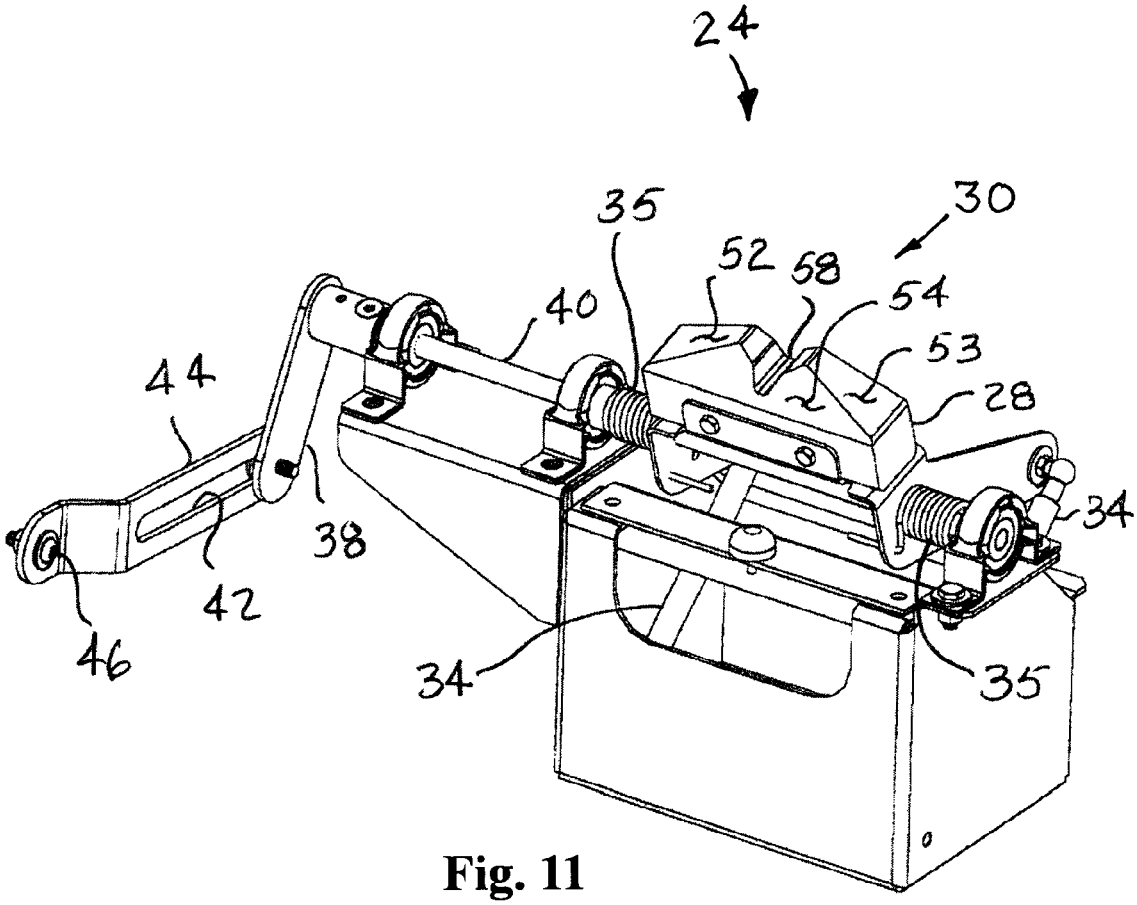
FIG. 11 is a perspective view of the subassembly of FIG. 9, except shown in an UNLOCKED position.

Referring now to FIGS. 3, 4 and 11 the frame positioning apparatus 24 may be seen in the first position 30 (corresponding to the "door-closed" condition), where the second stop block 28 is located out of alignment with the first stop block 26, allowing free rotation of the frame 16 during a mixing cycle.

The above described vertical stop feature holds the rotatable frame 16 in a vertical and upright position to assist with unloading and loading the paint container. When the access door 12 is opened, the frame positioning apparatus 24 operates to move the second stop block 28 into the position 32 to engage the first stop block 26 carried on the frame 16. The travel speed or delay of that movement is determined by the mechanical impedance (or viscous damping) of dampers 34 and the spring constant of helical torsion springs 35 (or the force delivered if an alternative to springs 35 is used). When the rotatable frame 16 is manually urged to the upright position, the second stop block 28 engages the first stop block 26 and retained in that position until the door 12 is closed. When the door 12 is closed, the frame positioning apparatus 24 moves the second stop block 28 out of engagement with the first stop block 26 and out of the path of the first stop block 26, allowing the frame 16 to rotate.

Figure 14:
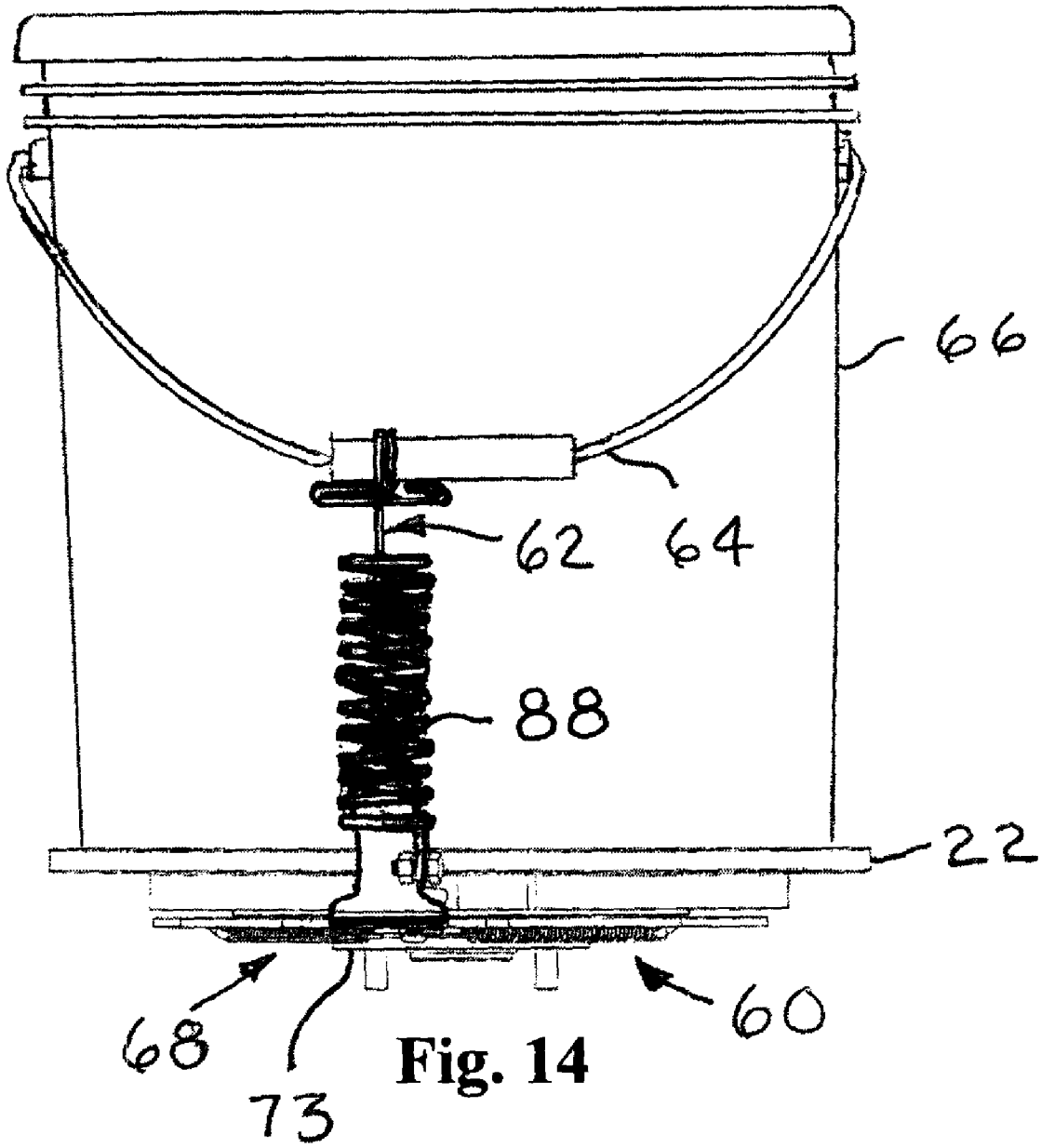
FIG. 14 is a side elevation view of the lower clamping plate and bail retention subassembly of FIG. 12, shown with a paint container resting on the plate and with the bail retained against the container by the subassembly.

Referring now to FIGS. 12-17, a further aspect of the present invention may be seen. In this aspect the present invention includes a retraction mechanism 60 for a bail retainer 62 in the gyroscopic paint mixer 10. The retraction mechanism 60 supports the bail retainer 62. As is shown in FIG. 14, the bail retainer 62 may be manually engaged with a paint container bail 64 to hold the bail adjacent the paint container 66 during mixing. The retraction mechanism 60 has a carriage assembly 68 controlling the bail retainer 62 when released from the bail 64. The carriage assembly 68 is mounted for rotation with respect to one of the clamp plates. In the embodiment shown, the clamp plate 22 is circular with an outer circumference and the carriage assembly supports the bail retainer 62 and permits positioning of the bail retainer 62 at a desired location on the circumference of the clamp plate 22, as shown in FIG. 14. The carriage assembly 68 also has means for urging the bail retainer away from a position in front of the paint container 66 when the bail retainer 62 is released from the bail 64 and when the paint container 66 is in an upright position in the rotatable frame 16. The means for urging the bail retainer moves the bail retainer 62 to a side region 70 of the rotatable frame 16 when the bail retainer 62 is released from the paint container bail 64 and the paint container is in an upright position in the rotatable frame 16.

Referring now to FIGS. 12-17, the means for urging the bail retainer may include the retraction mechanism 60 and equivalents. The retraction mechanism 60 preferably includes the carriage assembly 68 and a cam surface 72 on the clamp plate 22.

The carriage assembly 68 includes cam follower 74. The carriage assembly 68 also includes at least one resilient element 75 urging the cam follower 74 against the cam surface 72. In the embodiment shown, two springs 75 are preferred for resilient element 75. The cam surface 72 includes a pair of lobes 76, 78 and a pair of cusps or recesses 80, with the cusps 80 located to position the bail retainer 62 to the nearest side region 70 (or 70') when the bail retainer 62 is released from the paint container 66. The carriage assembly 68 also may include a carriage plate 69 rotatably mounted to clamp plate 22.

The retraction mechanism 60 may further include a circular track 82 on the underside of the clamp plate 22. The carriage assembly 68 also includes a plurality of rolling elements 84 on the carriage plate 69 in contact with the circular track 82 to hold and guide the carriage assembly 68 around the circumference of the plate 22 as the cam follower 74 rotatingly drives the carriage assembly 68 in response to the action of spring 75 driving the cam follower 74 along the surface of lobe 76 or 78 until the cam follower 74 reaches one of the cusps 80, at which time the bail retainer 62 will be positioned to one of the side regions (as for example, indicated at region 70 in FIG. 6) of the frame 16 and out of the way of the paint container for loading and unloading.

In the embodiment shown, lobe 76 is smaller than lobe 78 and is preferably aligned with the front of plate 22 when the frame is upright in the mixer because of the integer ratio between the spin and tumble rotations. Lobe 78 has a larger principal radius to extend spring 75 further at the principal or maximum radius, providing more motive (rotational) force in the event the bail retainer is located to the rear of the paint container when the frame is upright. It may be noted that the cusps are preferably located to one side and in front of a diameter of the plate 22, to provide convenient access to the bail retainer 62 in either of its rest positions, which are slightly in front of the lead screws of the frame 16, an example of which is shown in FIGS. 6 and 7.

Figure 12:
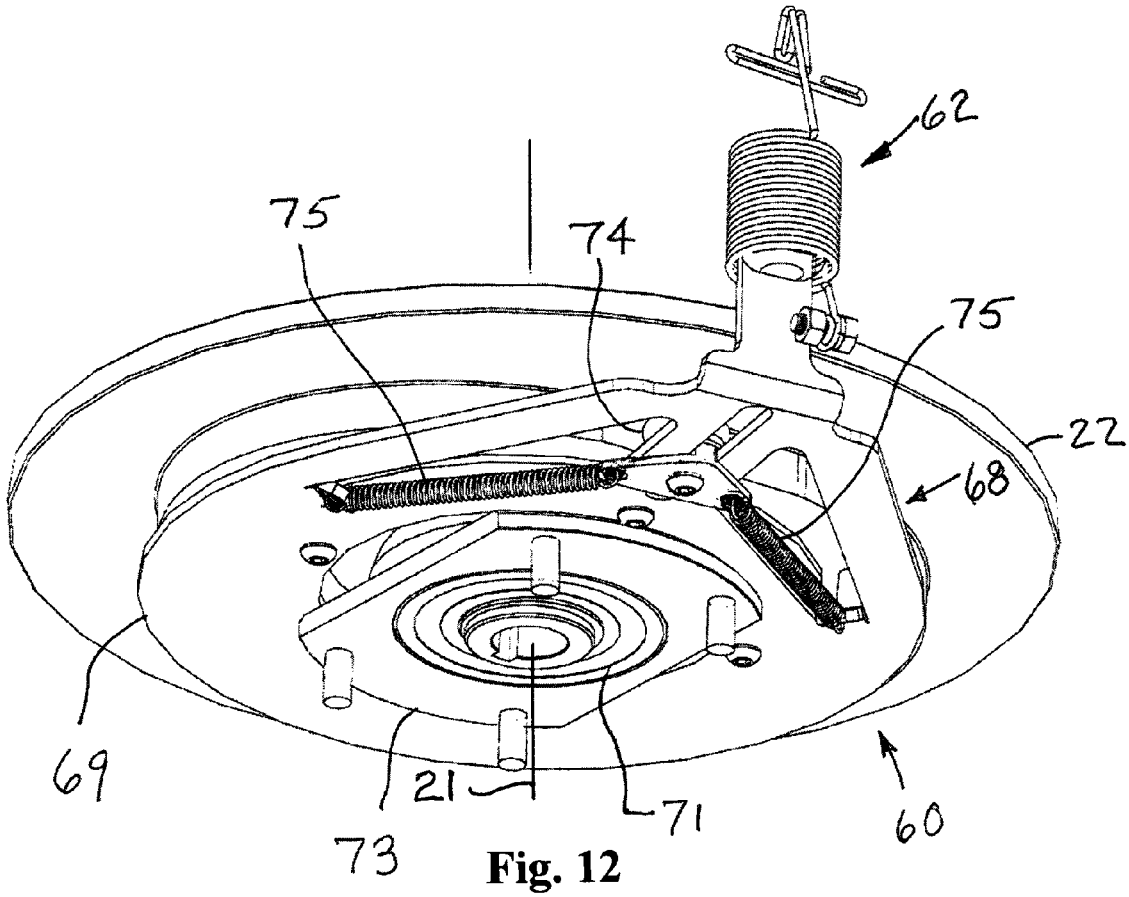
FIG. 12 is a perspective view from the front and below of a lower clamping plate and bail retention subassembly useful in the practice of the present invention.
Figure 13:
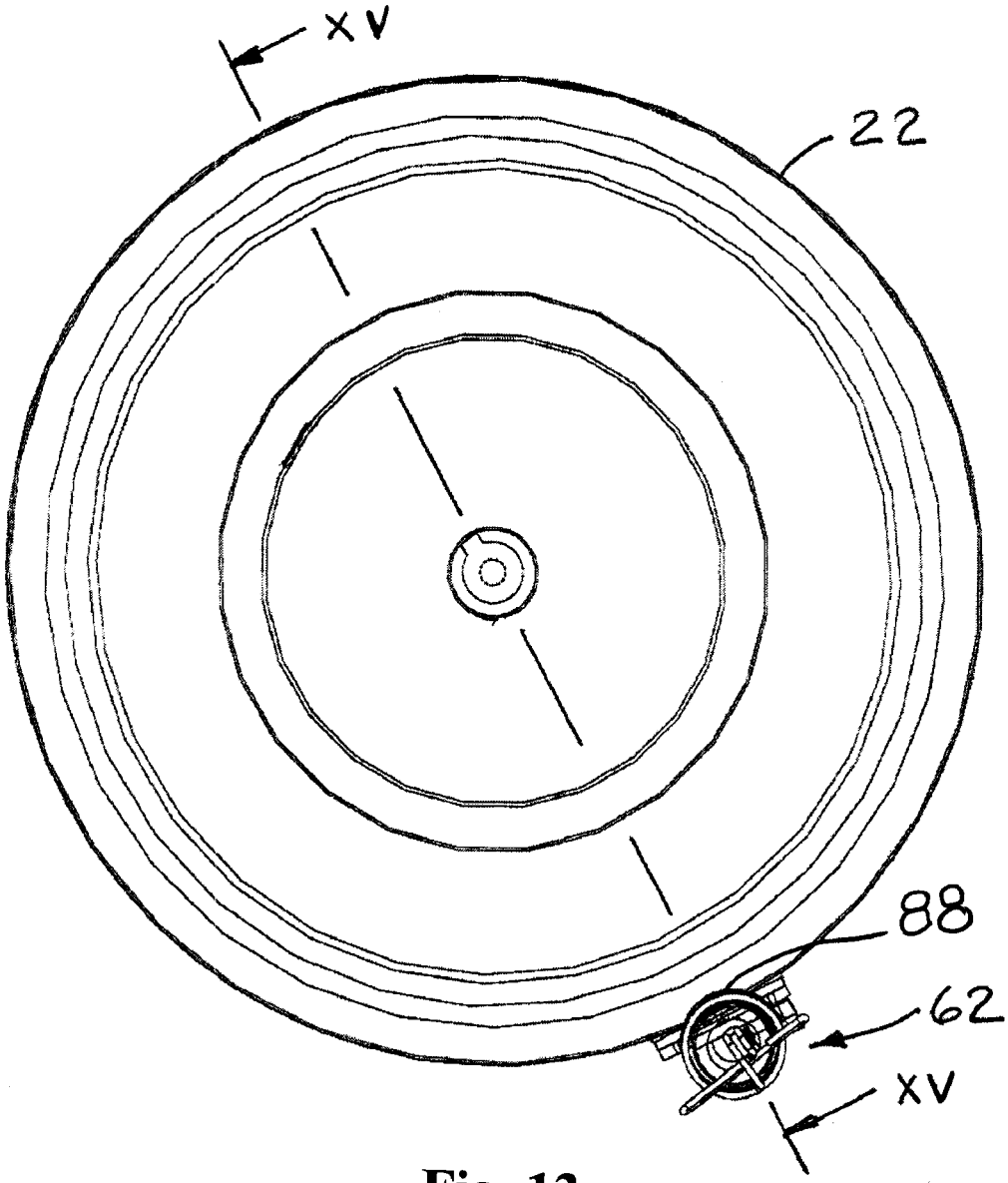
FIG. 13 is a top plan view of the lower clamping plate and bail retention subassembly of FIG. 12.
Figure 15:
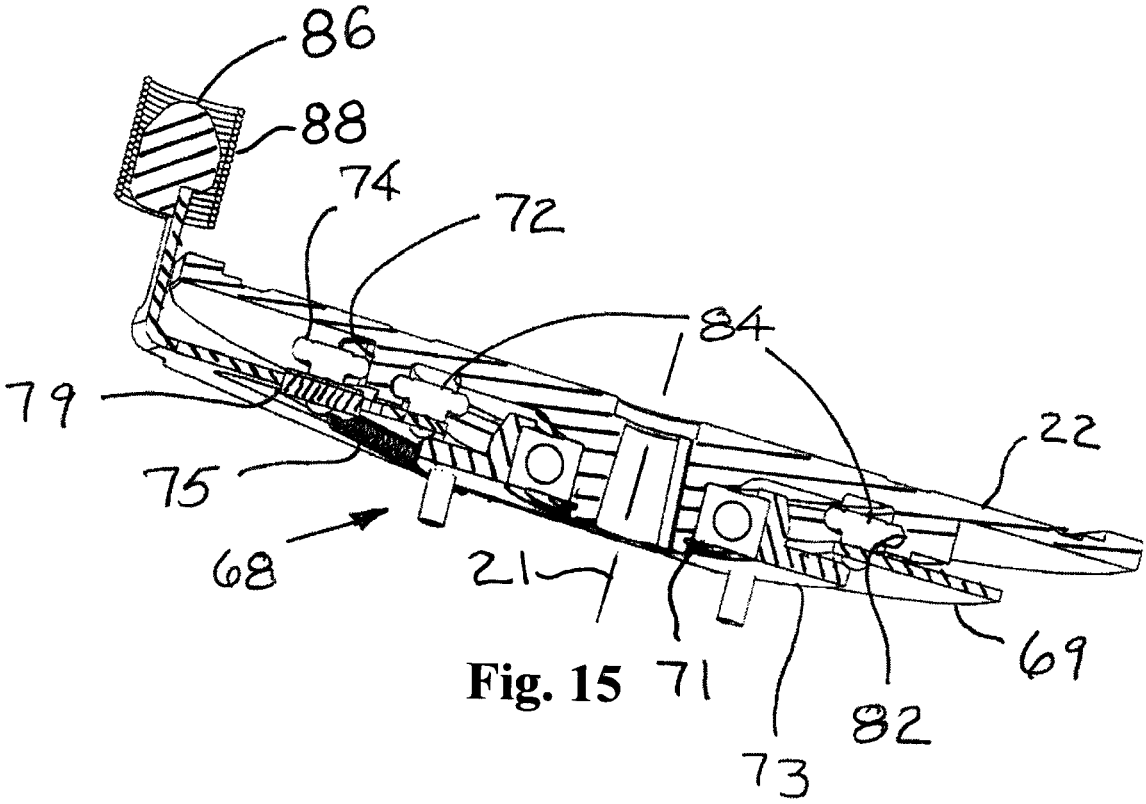
FIG. 15 is a section view taken along line XV-XV of FIG. 13.
Figure 16:
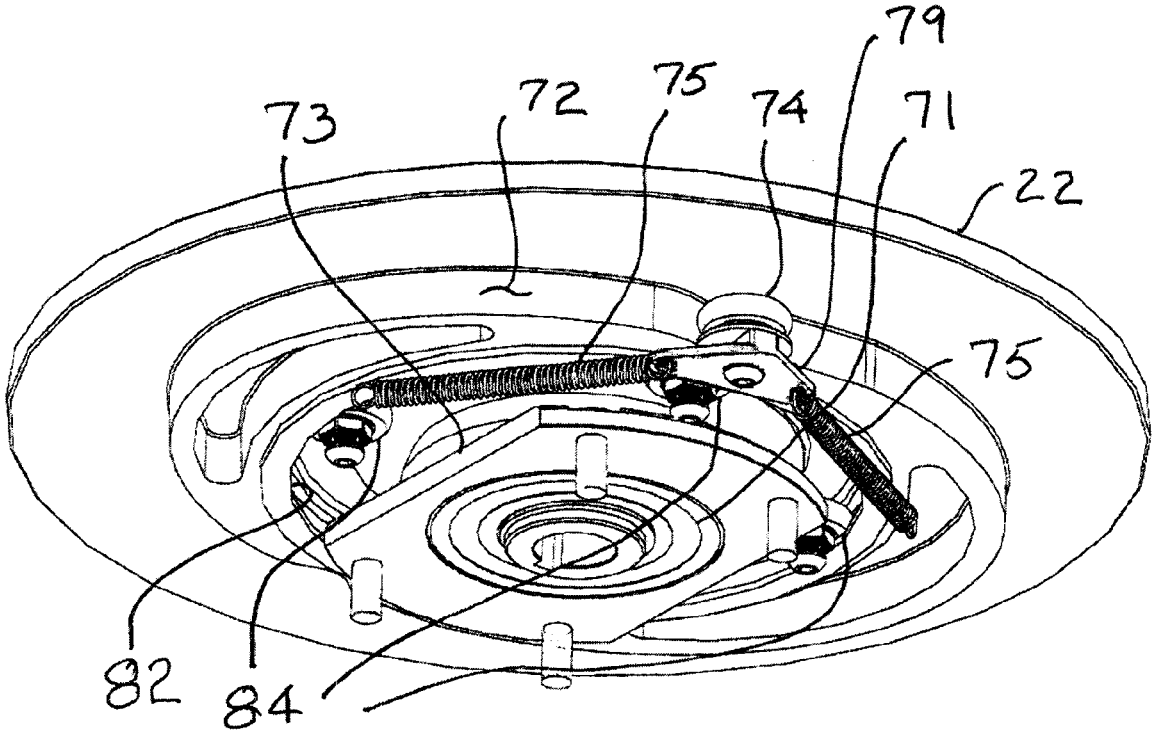
FIG. 16 is a view similar to that of FIG. 12, except with parts removed to better illustrate certain features of the present invention.

Referring now most particularly to FIGS. 12, 15 and 16, the clamp plate 22 is keyed to a drive subassembly to cause rotation about the spin axis 21. A bearing 71 supports the clamp plate 22 in a support plate 73 which is bolted to a lower frame cross bar 77 (visible in FIGS. 3, 4, 5 and 7). The carriage plate 69 has been omitted in FIG. 16 to more clearly show the remaining parts of the carriage assembly 68. Cam follower 74 is supported by a sliding element 79 which is connected to the carriage plate 69 by springs 75.

Figure 17:
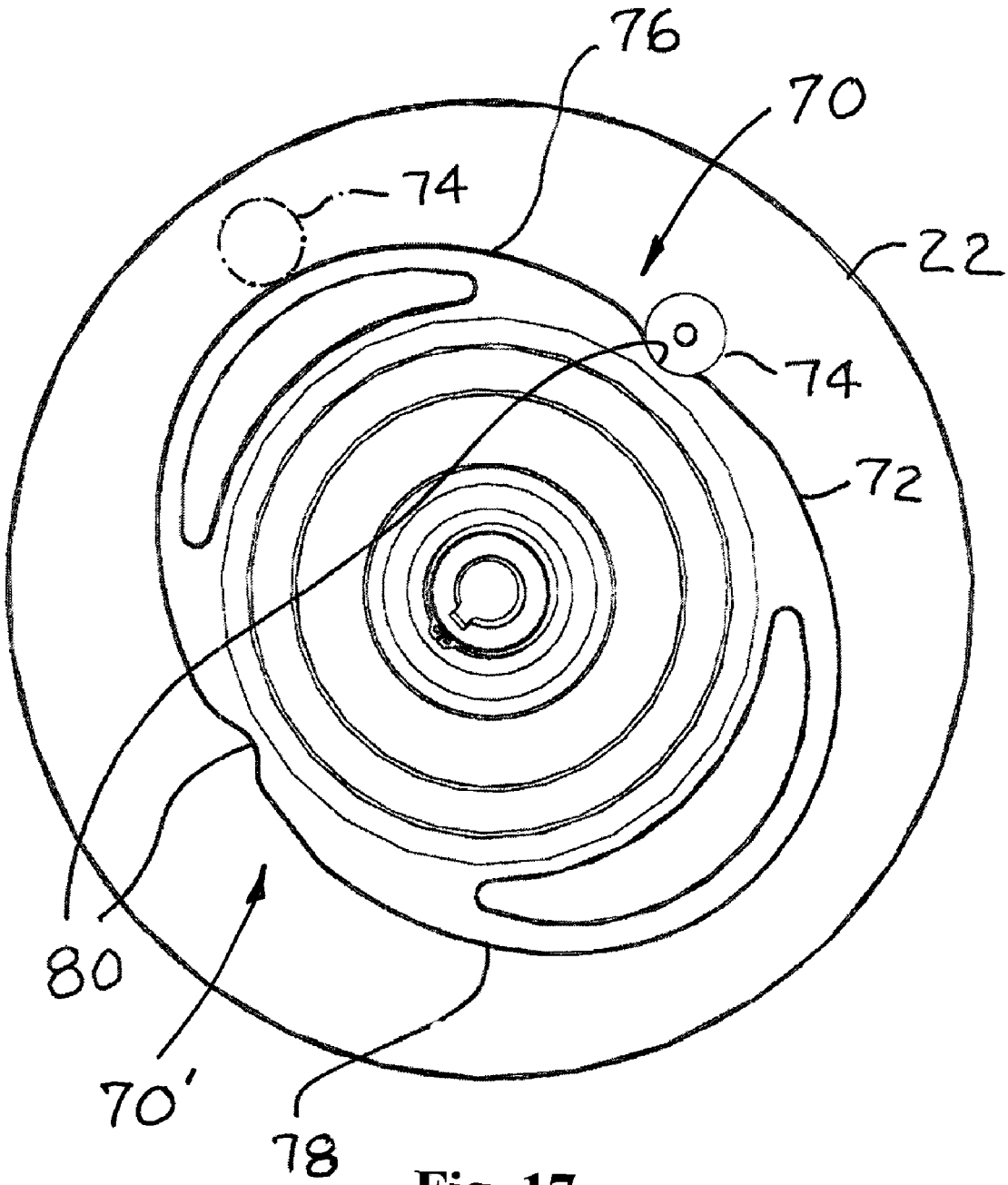
FIG. 17 is a bottom plan view of the lower clamping plate with a bail return roller shown in a rest position in solid and in a displaced position in phantom.
Figure 18:
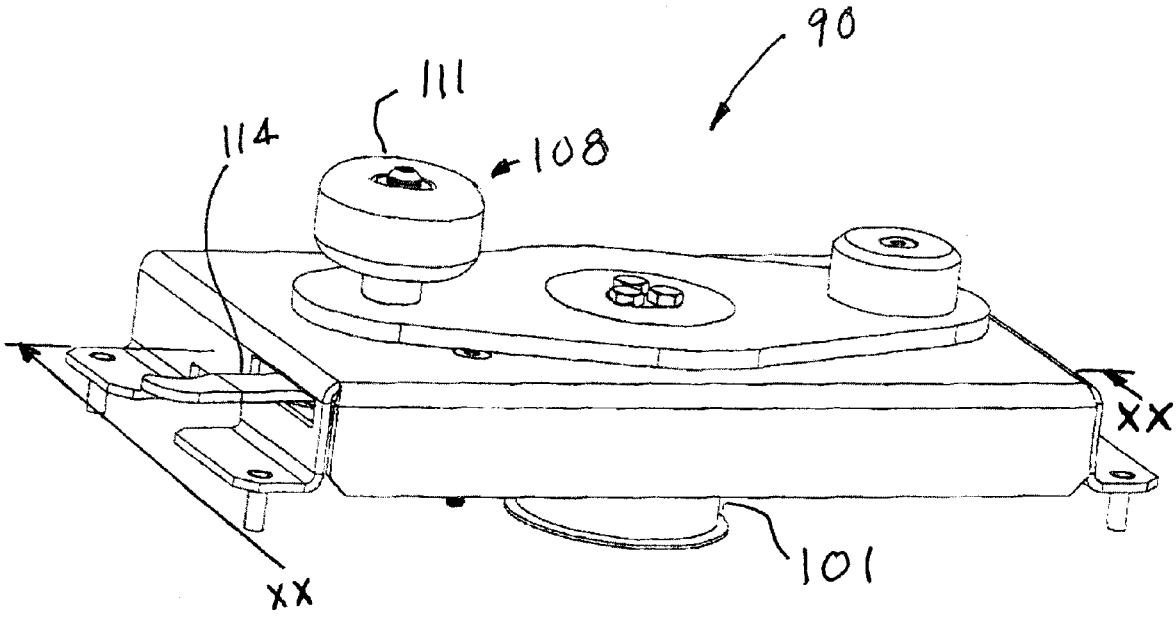
FIG. 18 is a perspective view from the front and above of a clamp lock mechanism useful in the practice of the present invention.
Figure 19:
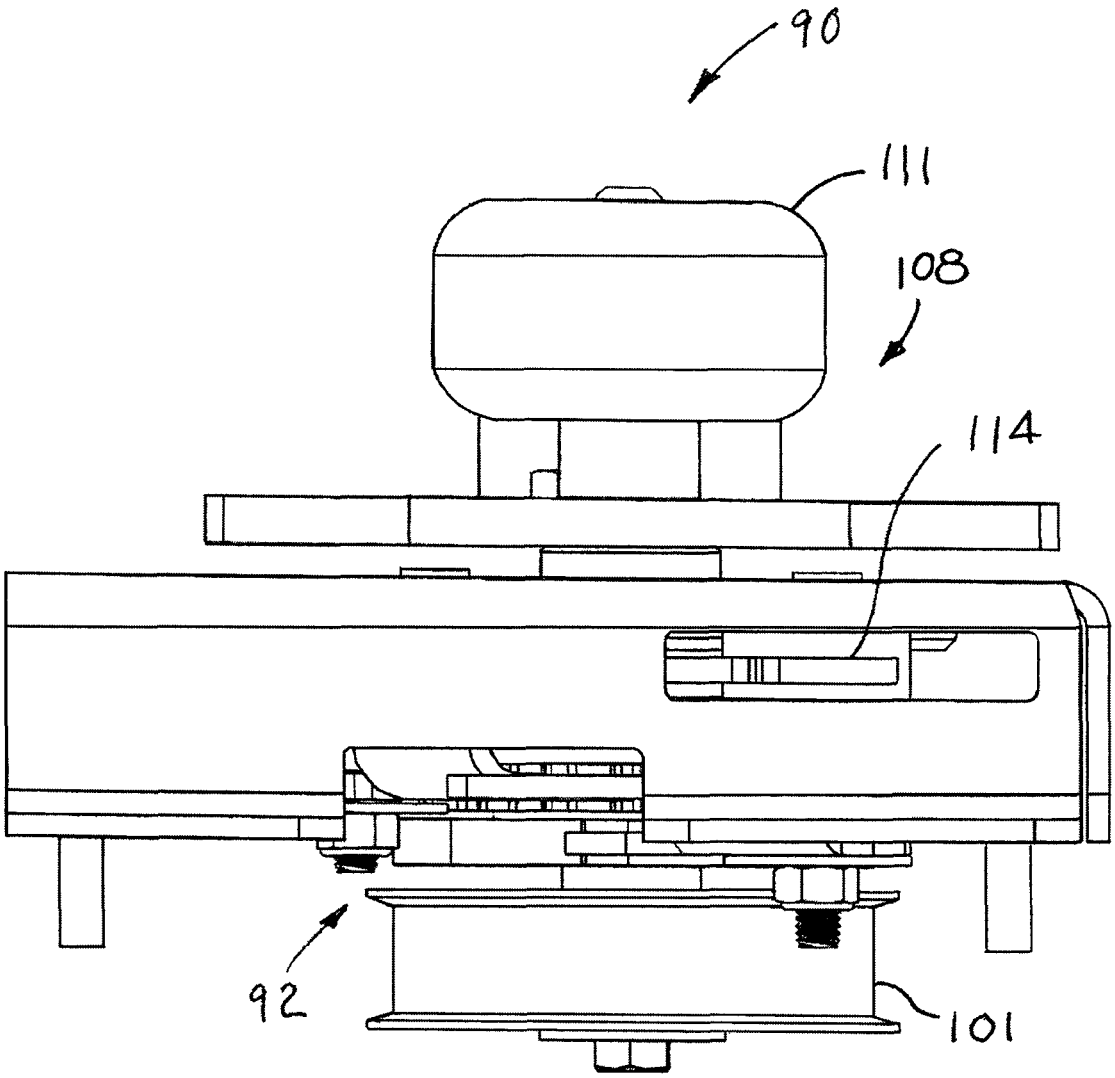
FIG. 19 is an enlarged side elevation view of the clamp lock mechanism of FIG. 18.
Figure 20:
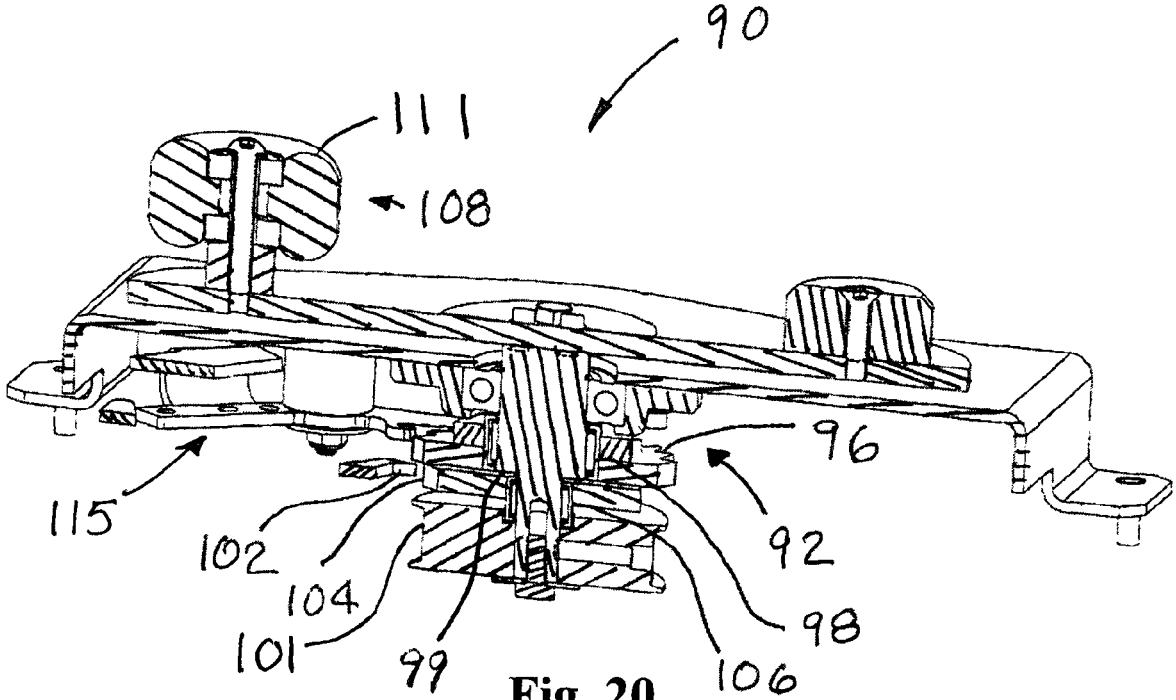
FIG. 20 is a section view taken along line XX-XX of FIG. 18.

FIG. 17 schematically illustrates the cam follower 74 in broken lines positioned where the carriage assembly 68 would be located when it is near the principal or maximum radius of the smaller front lobe 76. FIG. 16 has the carriage plate 69 omitted to further illustrate certain aspects of the carriage assembly 68 and the retraction mechanism 60.

One benefit of the bail retraction mechanism 60 is to automatically move the bail retainer 62 to either the left or right side of the paint container (i.e., to one of the side regions 70 or 70') when the retainer is released, thus enabling substantially unrestricted unloading or loading of the container. It also provides convenient and repeatable access to the bail retainer 62 for the user.

In another aspect, the present invention includes an improved a bail retainer 62 (illustrated in FIGS. 14 and 15) in combination with a paint mixer of the type having a rotatable frame with opposed clamp plates to hold a paint container for mixing. In this aspect, the improved bail retainer 62 includes an internal reinforcing member 86. The reinforcing member 86 in the embodiment shown is in the form of a solid core located within a helical spring 88 forming the bail retainer 62 for holding the paint container bail adjacent the paint container during mixing. However, it is to be understood that this aspect of the present invention may be practiced with a reinforcing member that is hollow, provided that the spring is protected against inelastic deformation in the event the bail retainer is struck by a paint container or other object. The reinforcing member 86 supports the helical spring 88 against deformation when contacted by a paint container being loaded or unloaded in the paint mixer. The material of the reinforcing member is preferably metal, but other materials may be used while still remaining within the scope of this aspect of the present invention. In the embodiment shown, the reinforcing member 86 preferably has a generally bullet-shaped cross section to provide a streamlined surface for reception of the helical spring 88 of the bail retainer when released from retaining a bail. In the practice of the present invention, the reinforcing member 86 may be made of sheet metal, if desired, while still having a streamlined surface.

Referring now to FIGS. 18-22, in another aspect the present invention includes an improved clamp lock 90 for clamping and locking the pair of opposed clamp plates 20, 22 to hold a paint container in a paint mixer of the type having a movable frame to mix paint, for example mixer 10. It is to be understood that the clamp lock 90 of the present invention may be used with mixers other than gyroscopic mixers while still remaining within the scope of this aspect of the present invention. One benefit of this clamp lock 90 is to provide a positive anti-back-drive feature when mixing a container while eliminating the need to hold a ratchet release lever or trigger while unclamping. When used with a pair of one way clutches, this clamp lock also provides quiet operation without requiring a user to hold the ratchet release lever while clamping. In short, with the clamp lock of the present invention, a user needs only pull (or actuate) the trigger momentarily to release the lock after which the handle may be moved to release the clamp; the clamp lock will automatically "reset" to the locking mode once the handle is moved in the clamping direction.

The clamp lock 90 may include a rotatable knob 111 on handle 108 operable to move the clamp lock in the first direction 110 in the CLAMPING condition and (alternatively) in the second direction 112 in the UNCLAMPING condition.

Various versions of the clamp lock of the present invention are possible. In a preferred version or first embodiment of the clamp lock, a pair of one-way clutches are used to provide silent operation in both the clamping and unclamping modes of operation. In a second embodiment, the clamp lock may include only one of the pair of one-way clutches with a rigid connection replacing the other one-way clutch. In the second embodiment, the one-way clutch is preferably used to provide a silent unclamping mode with a ratcheting or clicking sound during clamping. A third embodiment also uses a single one-way clutch and a rigid connection, except with their locations interchanged from the second embodiment. The third embodiment provides a silent clamping mode, but may have a ratcheting or clicking sound during unclamping. Finally, certain aspects of the present invention may be practiced with a rigid connection replacing both one-way clutches in a fourth embodiment, which may not be silent in either clamping or unclamping.

In the first embodiment (with two one-way clutches), the clamp lock 90 may include a locking mechanism 92 positionable to a LOCKED or CLAMPING position or condition 93 (shown in FIG. 21) wherein a first pawl 94 engages a first toothed wheel 96 connected by a first one-way clutch 98 to a lock drive shaft 99 to permit movement of at least one clamp plate towards the other clamp plate (i.e., a CLAMPING direction, indicated by arrow 109) while preventing the at least one clamp plate from moving away from the other clamp plate. It is to be understood that lock drive shaft 99 is positively or rigidly connected to rotate a cog belt drive pulley 101 (shown in FIGS. 18-20) in both CW (clockwise) and CCW (counterclockwise) directions to rotate the lead screws in rotatable frame 16. In the embodiment shown, both clamp plates move towards each other for clamping and both move away from each other during unclamping (as driven by the lead screws), but it is to be understood that this aspect of the present invention is applicable to systems having only one moving clamp plate. When the clamp lock 90 of this first embodiment is moved in the CLAMPING direction, operation is silent.

In the practice of this aspect of the invention (in each of the embodiments described), the locking mechanism 92 is positionable by manual actuation of a trigger 114 from the LOCKED condition described above to an UNLOCKED or UNCLAMPING position or condition 100 (shown in FIG. 22) wherein the first pawl 94 is thereafter automatically maintained disengaged from the first toothed wheel 96 (after the manual actuation of the trigger 114 and without CLAMPING motion of the handle 108), allowing the at least one clamp plate to move away from the other clamp plate in a silent UNCLAMPING operation in direction 112. In the UNLOCKED or UNCLAMPING condition 100 (shown in FIG. 22) the first pawl 94 is moved and held away from the first toothed wheel 96 by manual movement of the trigger 114. Trigger 114 is connected to an extension 115 of the first pawl 94 which, in turn, allows a projection 116 on the extension 115 of the first pawl 94 to be retained by a recess 118 in an extension 117 of the second pawl 102. At the same time, this movement of the second pawl 102 causes the second pawl 102 to move into the path of the teeth 119 of a second toothed wheel 104. In this first embodiment, the second toothed wheel 104 is connected to the lock drive shaft 99 by a second one-way clutch 106, and the clutch 106 (see FIG. 20) is in a released condition during UNCLAMPING operation, permitting the locking mechanism 92 and the clamp lock 90 to remain in the UNLOCKED condition 100 because the second pawl 102 will not be forced out of engagement with the second toothed wheel 104 during UNCLAMPING operation.

Figure 21:
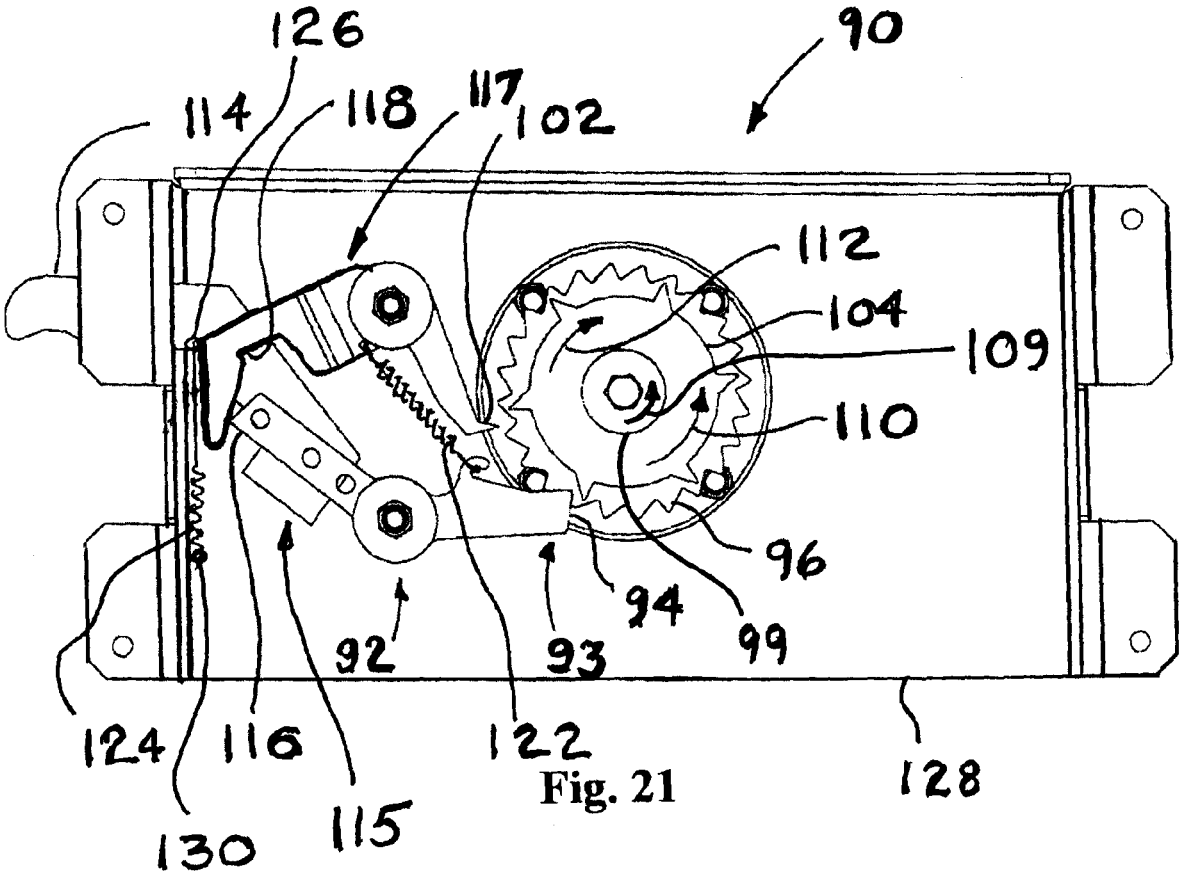
FIG. 21 is a bottom plan view with parts omitted to show the clamp lock mechanism in a LOCKED position.
Figure 22:
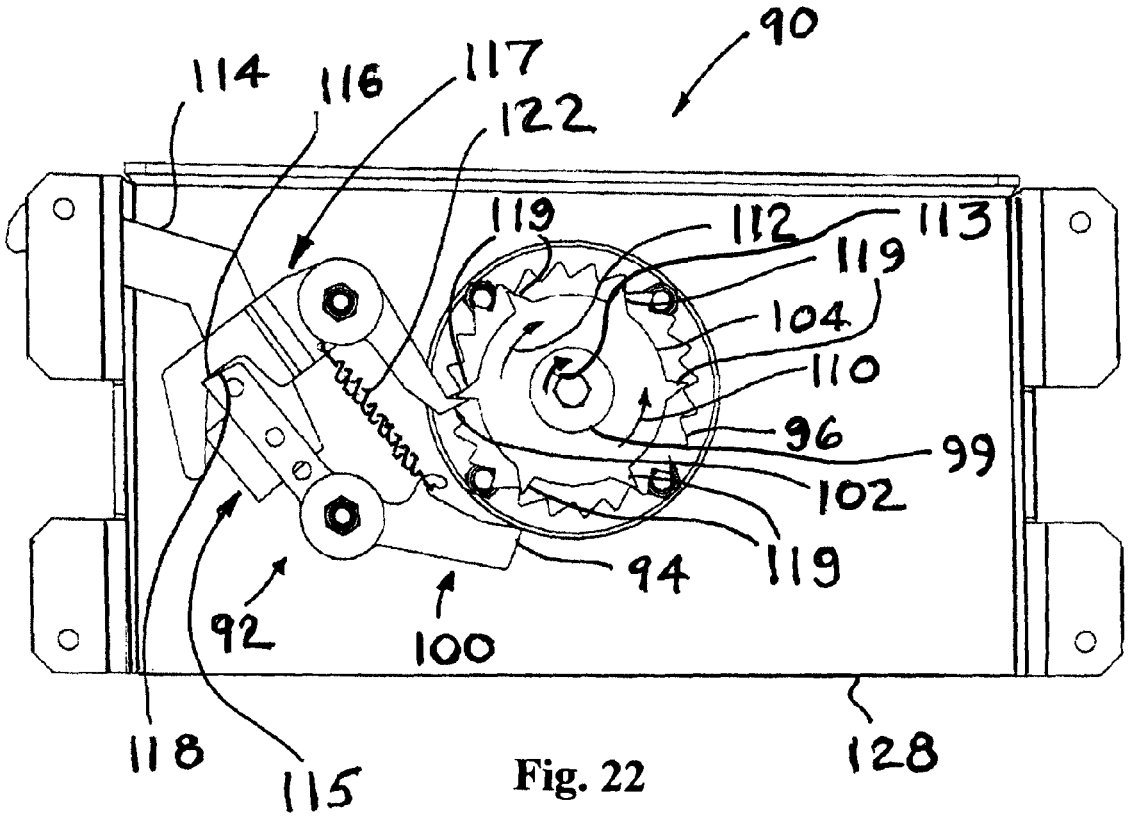
FIG. 22 is a bottom plan view similar to that of FIG. 21, except with parts shown in an UNLOCKED position.

Referring now to both FIGS. 21 and 22, with the clamp lock 90 in the UNLOCKED condition (as shown in FIG. 22) when the handle 108 is moved initially in a CLAMPING mode of operation, it is to be understood that handle 108 turns the lock drive shaft 99 in a CCW (counterclockwise) direction (when viewing the apparatus from below, as is shown in FIGS. 21 and 22) as indicated by arrow 109 in FIG. 21. The second one-way clutch 106 will then be in an engaged condition and will rotate the second toothed wheel 104 in the CCW direction 110 to release the projection 116 from recess 118 because the second one-way clutch 106 drives the second pawl 102 with a tooth 119 on the second toothed wheel 104. This will transfer the locking mechanism to the LOCKED condition 92. In addition, with CCW rotation 113 of the lock drive shaft 99, the first one-way clutch 98 allows the shaft 99 to turn within the first toothed wheel 96. This allows silent operation in the CLAMPING mode (even though in the LOCKED condition 92) since the first toothed wheel 96 will not rotate with CCW rotation of the lock drive shaft 99. It may thus be seen that with the first embodiment (with two one-way clutches) in the LOCKED and CLAMPING mode, the first one-way clutch 98 is released, and the second one-way clutch 106 is engaged. Silent operation will occur in the UNCLAMPING mode while also remaining in the UNLOCKED condition 100, since the second one-way clutch 106 releases the second toothed wheel 104 from being driven by the lock drive shaft 99, and the first pawl 94 will be held away from the first toothed wheel 96. It may thus be seen that in the practice of the present invention using the first embodiment, the first and second one-way clutches are arranged to block motion in opposite rotational directions with respect to each other.

In the second embodiment, the first one-way clutch 98 is replaced by a fixed or rigid connection (not shown) between the first toothed wheel 96 and the lock drive shaft 99. This embodiment will have silent unclamping (because of the operation of the second one-way clutch 106), but will exhibit a ratcheting sound while clamping, as the first pawl 94 passes over the teeth of the first toothed wheel 96. In this embodiment, the automatic operation of the locking mechanism 92 is maintained, such that a manual actuation of the trigger 114 will move the mechanism 92 to the UNLOCKED condition 100, and subsequent rotation of the handle 108 in the CLAMPING direction will cause mechanism 92 to move to the LOCKED condition 93.

Figure 24:
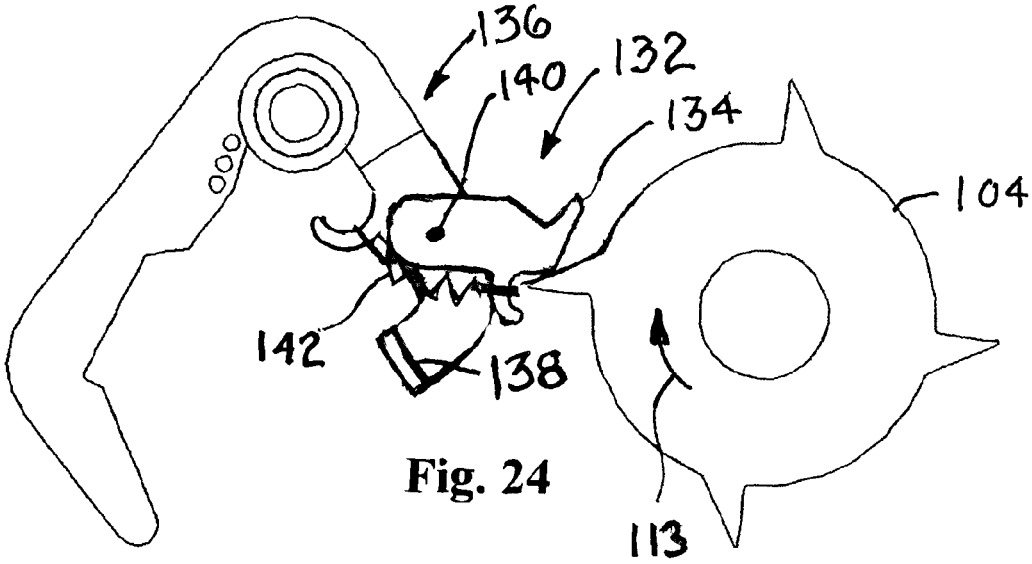
FIG. 24 is a view of the parts shown in FIG. 23, except with the one-way release mechanism in a second position.
Figure 23:
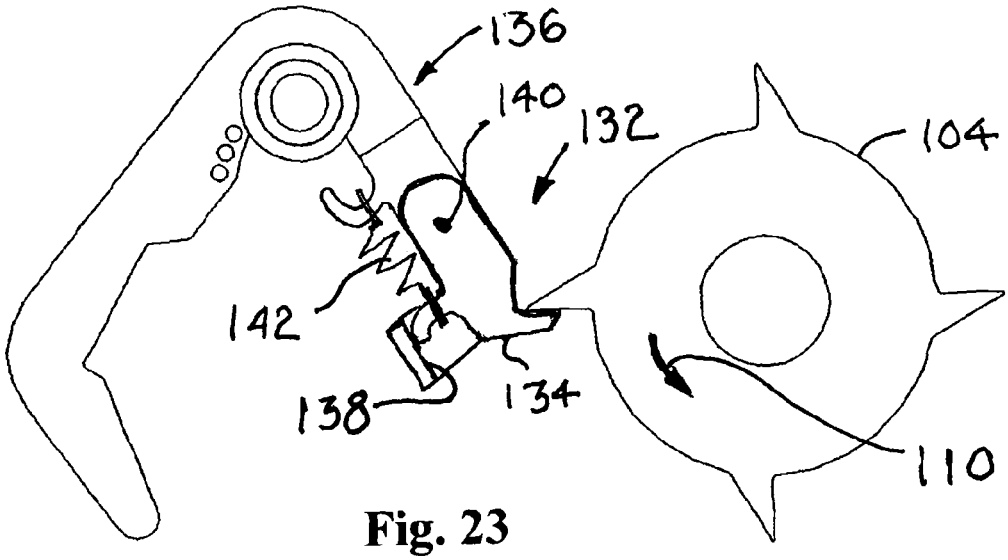
FIG. 23 is an enlarged simplified view of a second toothed wheel and second pawl from FIG. 22, except with the pawl modified to include an added one-way release mechanism in a first position.

In the third embodiment, the first one-way clutch 98 is retained, and the second one-way clutch 106 is replaced by a fixed or rigid connection (not shown) between the second toothed wheel 104 and the lock drive shaft 99. This embodiment will require an added one-way release mechanism, such as mechanism 132 shown in FIGS. 23 and 24. The one-way release mechanism 132 preferably includes a pivoting tooth 134 on a modified version of the second pawl 136 or, alternatively, may include pivoting teeth on the second toothed wheel 104 with a fixed tooth on the second pawl 102. This embodiment will have silent clamping (because of the operation of the first one-way clutch 98 releasing the first toothed wheel 96 to remain stationary during CLAMPING motion), but will exhibit a ratcheting sound while unclamping, as the added one-way release mechanism 132 actuates between the second pawl 136 and the teeth 119 of the second toothed wheel 104. As shown in FIG. 23, the second pawl 132 will operate in the same fashion as pawl 102 during CLAMPING motion 110 such that the second toothed wheel 104 will push the tooth 134 against stop 138 and move the second pawl 132 to the LOCKED condition by releasing the projection 116 from the recess 118. As shown in FIG. 24, during UNCLAMPING motion 113, the tooth 134 will pivot about an axis 140 allowing the second pawl 136 to remain in the UNLOCKED condition during UNCLAMPING. Spring 142 will urge the tooth 134 to the position shown in FIG. 23. The pivoting tooth 134 of the added one-way release mechanism 132 will prevent the second toothed wheel 104 and second pawl 136 from jamming together as the clamp lock 90 is moved in the UNCLAMPING direction 113, and the automatic operation of the locking mechanism 92 will be maintained. Manual actuation of the trigger 114 will move the mechanism 92 to the UNLOCKED condition 100 where it will remain during UNCLAMPING movement, while subsequent initial rotation of the handle 108 in the CLAMPING direction 109 will cause mechanism 92 to move to the LOCKED condition 93 where it will remain until the trigger 114 is manually actuated again.

In the fourth embodiment, both the first and second one-way clutches 98 and 106 are replaced by fixed or rigid connections (not shown), respectively, between the toothed wheels 96, 104 and the lock drive shaft 99. This embodiment will also require the added one-way release mechanism, such as mechanism 132 having the pivoting tooth 134 on the second pawl 136 or pivoting teeth on the second toothed wheel (not shown). Even though the first pawl 94 will be held disengaged from the first toothed wheel 96 during UNCLAMPING operation, this embodiment will nevertheless exhibit a ratcheting sound as the added one-way release mechanism actuates between the second pawl and the teeth of the second toothed wheel 104 during UNCLAMPING operation. The added one-way release mechanism will prevent the second toothed wheel and second pawl from jamming together as the clamp lock 90 is moved in the UNCLAMPING direction. The automatic operation of the locking mechanism 92 is maintained. Manual actuation of the trigger 114 will move the mechanism 92 to the UNLOCKED condition 100 where it will remain during UNCLAMPING movement, while subsequent initial rotation of the handle 108 in the CLAMPING direction will cause mechanism 92 to move to the LOCKED condition 93 where it will remain until the trigger 114 is manually actuated again. However, with this fourth embodiment, a ratcheting sound will also be present during CLAMPING operation with the first toothed wheel moving past the first pawl 94 as it engages successive teeth on the first toothed wheel 96.

It is to be understood that with any of the embodiments the projection 116 may be located on extension 117 and the recess 118 may be located on extension 115 connected to the trigger 114 while still remaining within the scope of this aspect of the present invention.

In each of the four embodiments described above, the present invention may utilize a single spring 122 which acts to urge the first pawl 94 into engagement with the first toothed wheel 96 and also acts to urge the second pawl 102 into engagement with second toothed wheel 104. Alternatively spring 122 may be a first spring, and a second spring 124 may be connected between the first pawl 94 (as for example through a hole 126 in trigger 114) and a mounting base 128 of the clamp lock 90 (as for example to a stud 130 secured to the base 128), if desired. When used, second spring 124 is operative to urge the first pawl 94 towards engagement with the first toothed wheel 96 and helps ensure positive operation of this aspect of the clamp lock 90. The second spring 124 may be used with any of the four embodiments described above.

It is to be understood that eliminating one or both of the one-way clutches will reduce cost, but with consequent loss of totally silent operation, even though the automatic trigger operation may be retained.

With any of the embodiments described above, if the direction of rotation is attempted to be reversed while in the LOCKED condition 92 (as shown in FIG. 21), the first pawl 94 remains engaged with the first toothed wheel 96, preventing motion in the UNCLAMPING direction (i.e., in a CW or clockwise direction 113). Either the first one-way clutch 98 or the solid connection will block rotation because of engagement of the first pawl 94 with the first toothed wheel 96, as shown in FIG. 21.

FIGS. 25 and 26 show enlarged piece part views of the stop blocks useful in the practice of the present invention. FIG. 25 shows the first stop block 26. FIG. 26 show the second stop block 28.

The invention is not to be taken as limited to all of the details thereof as modifications and variations thereof may be made without departing from the spirit or scope of the invention; accordingly:

What is claimed is:

1. A retraction mechanism for a bail retainer in a gyroscopic paint mixer of the type having a rotatable frame with opposed clamp plates to hold a paint container, the retraction mechanism comprising:

a) a bail retainer for holding a paint container bail adjacent the paint container during mixing b) a carriage assembly mounted for rotation with respect to one of the clamp plates, the one clamp plate having a circumference and the carriage assembly supporting the bail retainer and permitting positioning of the bail retainer at a desired location on the circumference of the one clamp plate, the carriage assembly having means for urging the bail retainer away from in front of the paint container when the bail retainer is released from the paint container with the paint container in an upright position in the rotatable frame.

2. The retraction mechanism of claim 1 wherein the means for urging the bail retainer away from in front of the paint container includes a retraction mechanism moving the bail retainer to a side region of the rotatable frame when the bail retainer is released from the paint container and the paint container is in an upright position in the rotatable frame.

3. The retraction mechanism of claim 1 wherein the means for urging the bail retainer away from in front of the paint container includes a cam surface on the one clamp plate and the carriage assembly includes cam follower.

4. The retraction mechanism of claim 3 wherein the carriage assembly includes at least one spring urging the cam follower against the cam surface.

5. The retraction mechanism of claim 4 wherein the cam surface includes at least one lobe and at least one cusp, with the at least one cusp located to position the bail retainer to a side region when the bail retainer is released from the paint container.

6. The retraction mechanism of claim 4 wherein the cam surface includes a pair of lobes and a pair of cusps, with the cusps located to position the bail retainer to the nearest side region when the bail retainer is released from the paint container.

7. The retraction mechanism of claim 1 further comprising a circular track on the underside of the one clamp plate and a plurality of rolling elements on the carriage assembly in contact with the circular track.

8. An improved bail retainer in combination with a gyroscopic paint mixer of the type having a rotatable frame with opposed clamp plates to hold a paint container, the improved bail retainer comprising a reinforcing member located within a helical spring forming the bail retainer for holding a paint container bail adjacent the paint container during mixing, wherein the reinforcing member supports the helical spring against deformation when contacted by a paint container being loaded or unloaded in the paint mixer.

9. The improved bail retainer of claim 8 wherein the reinforcing member is formed of metal.

10. The improved bail retainer of claim 8 wherein the reinforcing member has a streamlined surface.

* * * * *